US006000993A

United States Patent [19]

Erwin

[11] Patent Number: 6,000,993

[45] Date of Patent: Dec. 14, 1999

[54] LADY'S UNDER UNDERGARMENT

[75] Inventor: Doris Diann Erwin, Dallas, Tex.

[73] Assignee: Jane D. Hufstedler, Dallas, Tex.

[21] Appl. No.: 09/059,483

[22] Filed: Apr. 13, 1998

Related U.S. Application Data

[63] Continuation-in-part of application No. 08/846,548, Apr. 30, 1997, Pat. No. 5,772,492, which is a continuation-in-part of application No. 08/734,192, Oct. 21, 1995, abandoned, which is a continuation-in-part of application No. 08/459,179, Jun. 2, 1995, which is a continuation-in-part of application No. 08/425,981, Apr. 17, 1995, Pat. No. 5,667,422.

[51] Int. Cl.[6] ..... A41B 9/06; A41B 9/16

[52] U.S. Cl. ..... 450/7; 450/30; 450/95; 2/73; 2/106; 2/113

[58] Field of Search ..... 450/1, 2, 3, 4, 450/5, 6, 7, 8, 9, 10, 11, 12, 13, 14, 15, 16, 17, 18, 19, 20, 21, 22, 105, 104, 102, 103, 23, 24, 25, 26, 27, 28, 29, 30, 31, 92, 93, 95; 2/73, 75, 105, 106, 107, 109, 110, 112, 113, 114, 115, 400, 401, 402, 403, 404, 405, 406, 407, 408

[56] References Cited

U.S. PATENT DOCUMENTS

| | | | |
|---|---|---|---|
| 709,200 | 9/1902 | Buckley . | |
| 1,077,188 | 10/1913 | Condit . | |
| 1,524,491 | 6/1925 | Erwin . | |
| 2,377,004 | 5/1945 | Hanes | 2/78 |
| 2,719,303 | 10/1955 | Lodenius | 2/105 |
| 3,064,265 | 11/1962 | Bridgewaters | 2/74 |
| 4,909,771 | 3/1990 | Bergman . | |

*Primary Examiner*—Jeanette Chapman

[57] ABSTRACT

A lady's undergarment is provided which has a front neck hole seam that is generally W-shaped and has a raised middle section which falls in between the user's breasts. The undergarment has a lower opening that is defined by a generally straight back hem and a bevel front hem which has a lowermost portion that is cut at an angle. The undergarment may include one strap or two straps or be strapless. A collar may be attached to the undergarment. The back hem of the lower opening of the undergarment may be sufficiently long to be passed between the legs of the user and extended upwards to be attached to the undergarment. The undergarment may include cushioning means at several different sections of the undergarment. Undergarments that are designed for women who are missing one or both breasts may have cushioning to line area where breast is missing. The undergarment may include a flap between the folds of the breasts. A basically triangular patch may be attached to the vicinity of and is designed to closely silhouette the front neck hole seam. Finally, the undergarment may be combined with and attached to a brassiere to be worn by the user as one unit.

The undergarment may be attached to and may include a girdle. The girdle may be combined with and attached to the undergarment as a padding or as an extension of the undergarment. If attached to the undergarment as an extension, the girdle may form legs for the undergarment or may form openings for passage of legs of user into and out of the undergarment.

22 Claims, 23 Drawing Sheets

LADY'S UNDER UNDERGARMENT

This application is a continuation-in-part of application Ser. No. 08/846,548, filed on Apr. 30, 1997, now U.S. Pat. No. 5,772,492, which is a continuation-in-part of application Ser. No. 08/734,192, filed on Oct. 21, 1996, now abandoned, which is a continuation-in-part of co-pending application Ser. No. 08/459,179, filed on Jun. 2, 1995, which is a continuation-in-part of co-pending application Ser. No. 08/425,981, filed on Apr. 17, 1995, now issued as U.S. Pat. No. 5,667,422.

BACKGROUND OF THE INVENTION

This invention relates to a lady's undergarment, at least part of which falls underneath one or more other undergarments (such as brassieres, girdles, braces, pantyhose etc.) which are being worn by the lady.

There is no garment on the market today that gives a woman relief from the discomforts associated with wearing a brassiere and some other undergarments. Brassieres and some other undergarments often slide, chafe, pinch, dig, push, bind and squeeze the body. Women with relatively large breasts, weight problems or other sensitivities (e.g. due to sunburn, surgery, braces, pregnancy and skin infections) have greater degrees of discomfort. Women with relatively large and heavy breasts are exposed to additional discomforts due to perspiration existing under and between the folds of the breasts. Some women stuff tissues in their cleavage area in order to absorb moisture. However, tissue becomes uncomfortable and soggy when wetted. The problems encountered by women with relatively heavy breasts are further compounded by the weight of the breasts. Straps of brassieres cut into the shoulders of heavy-breasted women, creating pain and deep ridges in the shoulders. Detachable pads can be used to wrap around straps of brassieres, but these are difficult to adjust, easily slip and are easily lost during washing and in drawers. A problem associated with many lady's undergarment is that they are not adjustable to various body shapes. A poorly adjustable undergarment leaves folds and bulk that are not only uncomfortable, but are visible through outer garments.

Some efforts have been made to provide comfortable brassieres. However, brassieres are expensive and many women are brand conscious and reluctant to change. An undergarment which can provide comfort for the user when wearing a brassiere is desirable.

This invention provides an undergarment that minimizes the discomforts associated with brassieres and with some other undergarments, that absorbs moisture existing under and in the folds of a lady's bosom, that cushions the areas of the lady's body which are under the pressure of other pieces of undergarments, that provides increased support for the breasts, that minimizes discomforts associated with the weight of the breasts, that provides cushion linings for missing breasts, that is adjustable in size, shape and form, that does not create new discomforts and that remains virtually invisible under clothing.

This invention also provides firm control for, supports and shapes various parts of the body that are covered by sections of the undergarment that are lined by a girdle.

OBJECTS OF THE INVENTION

A primary object of this invention is to provide an undergarment that decreases the discomfort of wearing a brassiere and of wearing some other undergarments.

Another object of this invention is to provide an undergarment which, when worn with a brassiere and with any other undergarments, is basically invisible under clothes.

A further object of this invention is to provide a lined undergarment which provides lining for wires and straps of brassieres and for pants.

A still further object of this invention is to provide an undergarment which eliminates perspiration discomfort and irritation under and at the folds of the breasts.

Yet another object of this invention is to provide an undergarment that is adjustable to various body shapes.

Still another object of this invention is to provide an undergarment that includes an attached brassiere or attached portions of a brassiere.

A further object of this invention is to provide an undergarment that provides firm control for, supports and shapes various parts of the body that are covered by sections of the undergarment that are lined by a girdle.

A final object of this invention is to provide an undergarment that, without requiring additional accessories, helps eliminate discomforts created by brassieres for women with relatively heavy breasts, women with missing breasts, elderly women, women using braces or other medical means related to breast problems and women with disadvantages that complicate their use of brassieres.

SUMMARY OF THE INVENTION

A lady's undergarment is provided which is made from a tubular fabric material and has an upper opening, a lower opening, a front side, a back side, a left side and a right side. Between the user's body and a portion of some other undergarments (such as brassiere), the undergarment provides a comfortable lining which absorbs perspiration and minimizes discomfort. The upper opening is formed by a neck hole that has a front neck hole seam and a back neck hole seam. The front neck hole seam of the upper opening is generally W-shaped and has a raised middle section which falls in between the user's breasts and divides the undergarment into two scoops. The front neck hole seam is cut to closely follow the lines of a brassiere. When the brassiere is worn, the undergarment is stably positioned and the visibility of the undergarment is minimal. The back neck hole seam of the upper opening is generally U-shaped, but may also have other shapes (e.g. V-shaped, semi-rectangular). The back neck hole seam may start as far up as the neck of the user. The lower opening of the undergarment is defined by a generally bevel front hem and a generally straight back hem. The lowermost portion of the front hem is preferably cut at an angle. The excess length provided by the front hem enables the front side of the undergarment to conform to the shape of the breasts such that the front and back hems are substantially even when the undergarment is worn.

The undergarment may have different arrangements of straps. A pair of straps may connect, upon passing over the person's shoulders, the front side of the undergarment to the back side of the undergarment. The undergarment may include only one strap that is adapted to pass around the user's neck and is mostly used with halters. The undergarment may include various forms of straps, such as adjustable straps that are not releasable, adjustable straps that are releasable, releasable straps that are not adjustable and straps that are neither adjustable nor releasable.

The undergarment may be strapless, designed to be used with a strapless brassiere. The back side of the strapless undergarment includes an upper section and a lower section. The front side of the strapless undergarment includes a lower section, but may or may not include an upper section. The lower section of the front side and of the back side of the strapless undergarment preferably have a basically co-linear, generally straight, top edge. If the front side of the strapless undergarment has an upper section, the upper section of the front side and of the back side of the strapless undergarment preferably have a basically co-linear top edge. When the strapless undergarment and the brassiere are worn, the upper section of the front side and of the back side of the strapless undergarment are turned over and cover a section of the strapless brassiere that rests on the lower section of the front side and on the lower section of the back side, respectively.

A collar may be attached to the undergarment at the vicinity of the upper opening of the undergarment. At the upper opening of the collared undergarment, a part of the collar may be attached to the back side of the collared undergarment and another part of the collar may be attached to the straps of the undergarment. The back side of the collared undergarment may reach as far up as the neck of the user. The collar may be attached to the back side of the undergarment to form a continuous back side that has no openings.

The back hem of the lower opening of the undergarment may be lower than the front hem of the lower opening. The back hem would be sufficiently low and would have a shape particularly designed to cover the buttocks of the user. The back hem could be passed between the legs of the user, turned upwards and extended upwards to be attached to the front side of the undergarment. Preferably, a portion of the back side that is adjacent to the lower opening is attached to a portion of the front side that is adjacent to the lower opening. The undergarment may have a non-separating crotch piece, with no closures.

The undergarment may also include cushioning means at several different sections of the undergarment. Cushioning may be provided by a number of pads attached to the undergarment or by adjusting parts of the undergarment to form layers. Cushioning means may be attached to the straps in an area that is adjacent to the shoulders, with the cushioning minimizing shoulder stresses and pain induced by the straps of brassieres. Shoulder pads are positioned in an area that is generally midway along the length of the first and second strap of the undergarment. A plurality of folds extending through an area adjacent to the shoulders may provide cushioning by forming multiple layers. Cushioning means may be used at the base of the neck when the undergarment has one strap that extends around the neck. A cushioning fold may extend across the front side of the undergarment and may have a seamed base. The cushioning fold may extend upwards from under the breasts to cover a portion of the breasts and may be shaped to serve as cups of the brassiere. In addition, cushioning may be used, by ladies who have undergone mastectomy, to line area where a breast is missing in the breast area. Undergarments that are designed for women who are missing one or both breasts may have cushioning to line the area where a breast is missing but may not have cushioning means for and may not cover any existing breast.

The undergarment may include a flap between the folds of the breasts to absorb moisture from the skin and to decrease irritation. The flap is preferably attached to the raised middle section of the undergarment. Some portions of edges of the flap may be attached to each other to form a pocket for holding powder and other ingredients that may be useful in decreasing the discomfort of perspiration between the breasts of the user.

A basically triangular patch may be attached to the vicinity of and is designed to closely silhouette the front neck hole seam. The patch is attached at two corners to the straps of the undergarment. The patch covers at least a portion of the chest that is not being covered by the undergarment and is helpful to line braces worn at the chest area.

The undergarment may be combined with and attached to a girdle to be worn by the user as one unit. The girdle may be combined with and attached to the undergarment as a padding or as an extension of the undergarment. If attached to the undergarment as an extension, the girdle may form legs for the undergarment or may form openings for passage of legs of user into and out of the undergarment.

Finally, the undergarment may be combined with and attached to a brassiere to be worn by the user as one unit.

BRIEF DESCRIPTION OF THE DRAWINGS

In order to represent the new features of the invention more clearly, the upper part of the body (i.e. the neck, the shoulders, the breasts and a part of the arms) of the user is shown in most drawings.

FIG. 1(*b*) is a back view of the undergarment shown in FIG. 1(*a*) when worn by the user.

FIG. 1(*c*) is a front view of the undergarment shown in FIG. 1(*a*) when worn by the user to underline a brassiere, with broken lines indicating a part of the undergarment that is positioned under the brassiere.

FIG. 1(*d*) is a back view of the undergarment of FIG. 1(*c*) when worm by the user to underline the brassiere.

FIG. 2(*b*) is a back view of the body-suit undergarment shown in FIG. 2(*a*) when worn by the user.

FIG. 3(*b*) is a back view of the collared undergarment shown in FIG. 3(*a*) when worn by the user.

FIG. 4(*b*) is an elevated angular view of the split-strap undergarment of FIG. 4(*a*) when worn by a user.

FIG. 4(*c*) is an elevated angular view of a version of a fastenable undergarment, which is used to sandwich straps of a brassiere, when the fastenable undergarment and the brassiere are worn by the user but the straps of the brassiere have not been sandwiched.

FIG. 4(*d*) is an elevated angular view of the fastenable undergarment of FIG. 4(*c*) when the straps of the brassiere have been sandwiched by the fastenable undergarment worn by the user.

FIG. 4(*e*) is an elevated angular view of a version of a split-strap undergarment, to be used with a brassiere designed for halters, when the split-strap undergarment is not being worn by a user.

FIG. 4(*f*) is an elevated angular view of the split-strap undergarment of FIG. 4(*e*) that is being worn by the user to underline the brassiere designed for halters.

FIG. 4(*g*) is a back view of the split-strap undergarment of FIG. 4(*f*) that is being worn by the user to underline the brassiere designed for halters.

FIG. 5(*b*) is a front view of the undergarment shown in FIG. 5(*a*) when worn by the user to underline a brassiere.

FIG. 6(*b*) is a back view of the strapless undergarment of FIG. 6(*a*) when worn by the user to underline the strapless brassiere, with the strapless brassiere shown by broken lines.

FIG. 7(*b*) is a front view of a cushioned undergarment when worn by a user, with cushionings serving as a lower portion of cups of a brassiere and shown by broken lines.

FIG. 8(*b*) is a front view of an undergarment for use by women with no breasts, with the undergarment being worn by the user and with the cushioning being shown by broken lines.

FIG. 9(*b*) is an angular view of the undergarment, when worn by the user, of FIG. 9(*a*) to which the patch is being attached.

FIG. 10(*b*) is a back view of the brassiere-undergarment of FIG. 10(*a*) when worn by the user.

FIG. 11(*b*) is a back view of the girdle-undergarment shown in FIG. 11(*a*) when worn by the user.

FIG. 12(*b*) is a back view of the girdle-undergarment of FIG. 12(*a*) when worn by the user to underline the brassiere.

FIG. 13(*b*) is a back view of the collared girdle-undergarment shown in FIG. 13(*a*), when worn by the user.

FIG. 14(*b*) is an elevated angular view of the split-strap girdle-undergarment of FIG. 14(*a*) that is being worn by the user to underline the brassiere designed for halters.

FIG. 15(*b*) is a back view of the body-suit undergarment of FIG. 15(*a*) when worn by the user.

FIG. 16(*b*) is a back view of the brassiere-undergarment shown in FIG. 16(*a*) when worn by the user.

FIG. 17(*b*) is a back view of the girdle-undergarment of FIG. 17(*a*) when worn by the user.

FIG. 18(*b*) is a back view of the girdle-undergarment shown in FIG. 18(*a*) when worn by the user.

DETAILED DESCRIPTION OF THE PREFERRED EMBODIMENTS

Figure 1B:
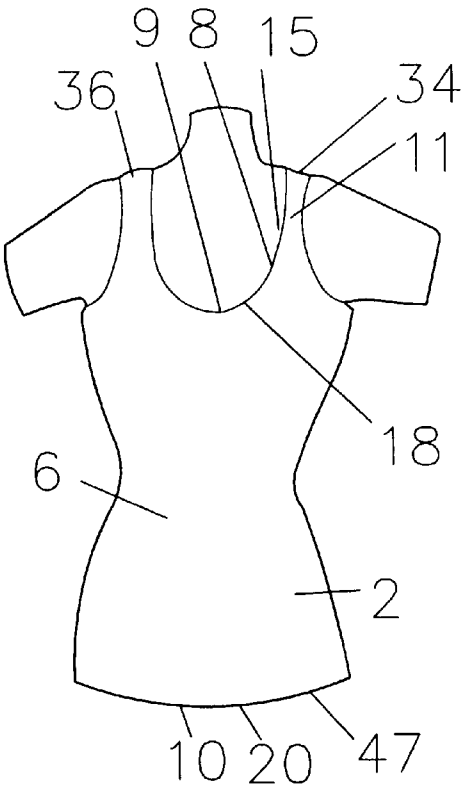
FIG. 1(*a*) is a front view of an undergarment when worn by a user.
Figure 1A:
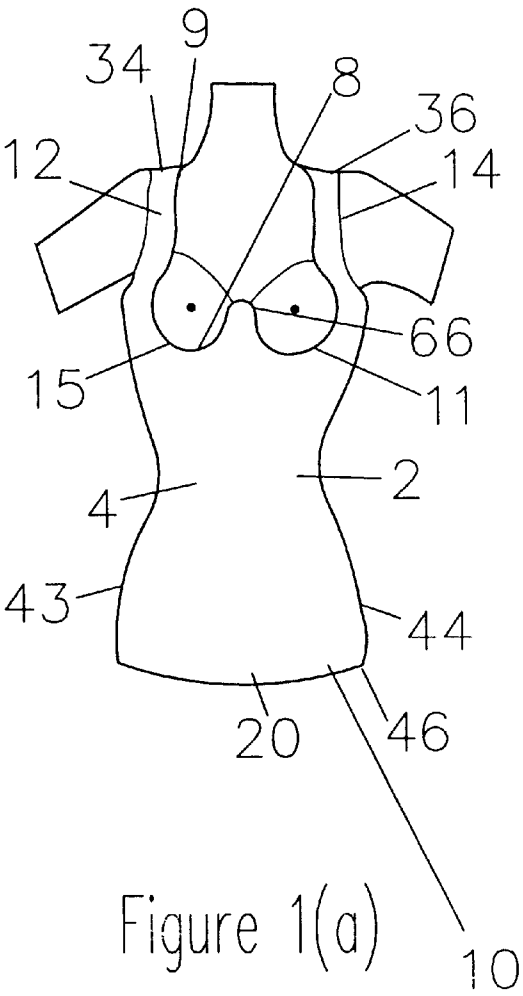
Figure 1D:
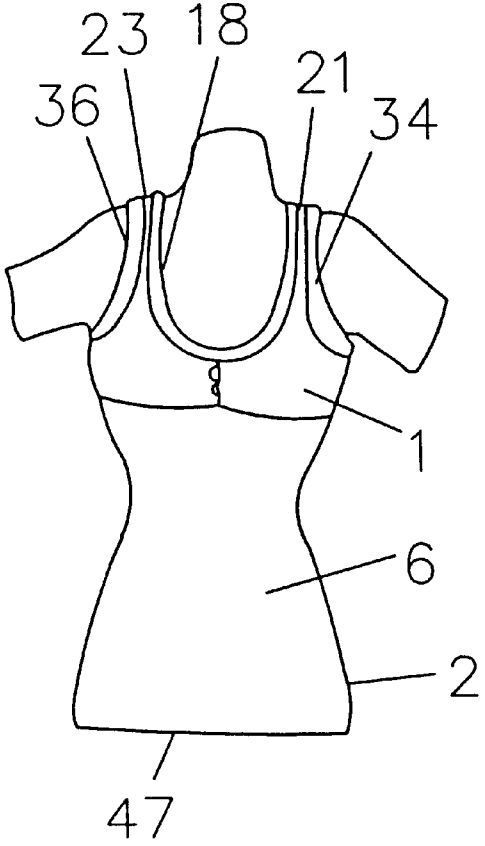
Figure 1C:
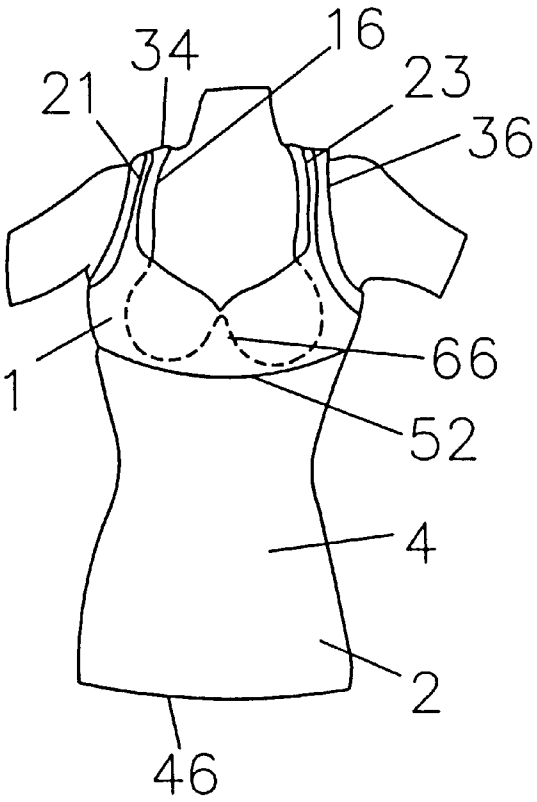

A detailed description of a few embodiments of the present invention is provided below. However, please note that the following embodiments are presented solely as samples and are not intended to place any limitations on the invention. Due to the numerous and various modifications that may readily occur to individuals skilled in the arts, the invention is not limited to the exact construction described here and shown in the drawings.

A first embodiment of a lady's undergarment 2 is best shown by FIGS. 1(*a*), 1(*b*), 1(*c*) and 1(*d*). The undergarment 2 has a front side 4 and a back side 6 which define an upper opening 8, a lower opening 10, a first armhole 12 and a second armhole 14.

The upper opening 8 is formed by a neck hole 9. The neck hole 9 is defined by a neck hole seam 11 which comprises a front neck hole seam 16 and a back neck hole seam 18. The front neck hole seam 16 is generally W-shaped and has a raised middle section 66 (as shown in FIG. 1(*a*)). The front neck hole seam 16 is cut to closely follow the lines of a brassiere 1. The raised middle section 66 of the "W" falls in between the user's breasts and divides the undergarment 2 into two scoops. When the brassiere 1 is worn, the undergarment 2 is stably positioned and the visibility of the undergarment 2 is minimal. The back neck hole seam 18 is generally U-shaped (refer to FIG. 1(*b*)). The W-shaped front neck hole seam 16 has a length preferably in the range of about 8 inches to about 16 inches. The front neck hole seam 16 preferably passes to a point between about 2 inches and about 8 inches below the arm's eye line. (Some features of the invention may be defined by reference to the arm's eye line, a line that is beneath the pair of arms and is measured at the lowest part of a garment armhole. There is a front arm's eye line and a back arm's eye line.) Preferably, the front neck hole seam 16 passes to a point in the range of about 2 inches to about 5 inches below the front arm's eye line. The U-shaped back neck hole seam 18 has a length ranging preferably from about 7 inches to about 18 inches. Although the back neck hole seam 18 could reach a point up to about 8 inches below the back arm's eye line, the back neck hole seam 18 is preferably positioned approximately at the level of the back arm's eye line and passes to a point up to the back arm's eye line or about 2 inches below the arm pit area of the wearer. It should be emphasized that other shapes of the front and back neck hole seam 16, 18 may be used as well. The undergarment 2 may even have a continuous back side 6 extending downwards from the neck of the person. However, an essential feature of the invention is the existence of the raised middle section 66 at the front neck hole seam 16, with this raised middle section 66 contributing to the stability of the undergarment 2 when being worn under a brassiere 1.

The lower opening 10 of the undergarment 2 is defined by a bottom seam 20 of the undergarment 2 and receives the lower portion of the body of the user. The lower opening 10 of the undergarment 2 is defined by a bevel front hem 46 on the front side 4, from left side 43 to right side 44, of the undergarment 2. On the back side 6, a generally straight back hem 47 is used. On the front side 4, the front hem 46 extends from a lower edge of the right side 44 to a lower edge of the left side 43 and has a lowermost portion which passes to a point below the back hem 47. The lowermost portion of the front hem 46 is cut at an angle and is preferably at least 2 inches longer than the back hem 47. The excess length provided by the front hem 46 allows for the front side 4 of the undergarment 2 to conform to the shape of the breasts such that the front hem 46 and the back hem 47 are substantially even when the undergarment 2 is worn.

The first armhole 12 and the second armhole 14 each have a lower end 24, 30 and are defined by a first armhole seam 26 and a second armhole seam 32, respectively. The first and the second armhole seam 26, 32 each follow an arcuate path. The lower end 24 of the first armhole 12 and the lower end 30 of the second armhole 14 each are similarly located and pass to a point up to about 8 inches below the arm's eye line. These measurements reduce the possibility that the undergarment 2 would be visible through the armhole of clothes.

The undergarment 2 may include various forms of straps, such as adjustable straps that are not releasable, adjustable straps that are releasable, releasable straps that are not adjustable and straps that are neither adjustable nor releasable. The undergarment 2 may include only one strap 38 that is adapted to pass around the user's neck and is mostly used with halters. On the other hand, the undergarment 2 may include a pair of straps 34, 36 that each connect the front side 4 of the undergarment 2 to the back side 6 of the undergarment 2 and that each are adapted to pass over the person's shoulder. The first strap 34 and the second strap 36 of the undergarment 2 are formed between the neck hole seam 11 and the first and the second armhole seam 26, 32, respectively.

Straps 34, 36 that are neither adjustable nor releasable are demonstrated in FIGS. 1(*a*) and 1(*b*). The straps 34, 36 in FIGS. 1(*a*) and 1(*b*) do not include any securing means (e.g. hook and loop fasteners, buttons, snaps etc.). The first and second strap 34, 36 of the undergarment 2 are positioned on the shoulders of the user. A brassiere 1, that is worn over the undergarment 2, has a first and second strap 21, 23 that are placed on the corresponding first and second strap 34, 36 of the undergarment 2. (Please refer to FIGS. 1(*c*) and 1(*d*).) The first and second strap 34, 36 of the undergarment 2 each have a width preferably ranging from about 1 inch to about 13 inches, as measured at an upper end 15 of the undergarment 2. Preferably, the first and second armhole seam 26, 32 are parallel to the neck hole seam 11 over a length of about 7 inches to about 18 inches. The configuration of the first and second strap 34, 36 makes the undergarment 2 unsuitable for use as an outer garment. Similarly, a non-adjustable and non-releasable strap 38 may be used with a brassiere 1 that is used with halters. (Please note that for most embodiments, the features that apply to two-strap undergarments 2 may be similarly applicable to one-strap undergarments 2. Some examples are describes for both versions. However, since the description for the one-strap and two-strap undergarments 2 would be closely related and deducting the corresponding features of one from the other would be obvious to one skilled in the art, only one version of the undergarment 2 will be described in detail for most embodiments.)

Various versions of securing means 35 (e.g. buttons) may be used for straps 34, 36 that are releasable. (Please refer to FIGS. 4(*a*), 4(*b*), 4(*e*), 4(*f*) and 4(*g*).) The securing means 35 may be released in order to separate components of the straps 34, 36 from one another or from the undergarment 2. If the straps 34, 36 are releasably attached, at each end, to the undergarment 2, upon disconnecting the attachment of the straps 34, 36 to the undergarment 2, the straps 34, 36 can be removed and, then, can be replaced by another strap or reattached. The securing means 35 may similarly be used for the strap 38 of the undergarment 2 worn under a brassiere 1 designed for a halter (shown in FIGS. 4(*e*), 4(*f*) and 4(*g*)). Thus, the same undergarment 2 could be worn with two straps 34, 36 or with one strap 38.

An embodiment of releasable straps 34, 36 follows. The first and second strap 34, 36 each may have sections that are releasably attached to one another (an undergarment 2 including said version of straps 34, 36 is referred to hereafter as "split-strap undergarment 2"). FIGS. 4(*a*) and 4(*b*) demonstrate a split-strap undergarment 2. The first strap 34 comprises a first front strap 34A and a first back strap 34B that is releasably attachable to the first front strap 34A. The second strap 36 comprises a second front strap 36A and a second back strap 36B that is releasably attachable to the second front strap 36A. The first front strap 34A and the second front strap 36A each, correspondingly, have a bottom side 34C, 36C and a means for fastening 34E, 36E positioned on the bottom side 34C, 36C. The first back strap 34B and the second back strap 36B each, correspondingly, have a top side 34D, 36D and a means for fastening 34F, 36F positioned on the top side 34D, 36D. The means for fastening 34E, 36E on the bottom side 34C, 36C of the first and second front strap 34A, 36A are each releasably affixable to the means for fastening 34F, 36F on the top side 34D, 36D of the first and second back strap 34B, 36B, respectively. In a preferred embodiment, the means for fastening 34F, 36F on the top side 34D, 36D of the first and second back strap 34B, 36B are made of hook material. The means for fastening 34E, 36E on the bottom side 34C, 36C of the first and second front strap 34A, 36A are made of loop material, with the loop material being adjustably positioned on the hook material. The first and second straps 34, 36 are, thus, fully openable and easily releasable, simplifying robing and disrobing, especially for heavier or older women.

Straps 34, 36 may be adjustable, allowing the undergarment 2 to adjust to almost any person's body, thus eliminating bulges and wrinkles which are visible through clothing. Various securing means 35 (e.g. hook and loop fasteners, buttons, snaps etc.) may be used to adjust the length of the straps 34, 36 of the undergarment 2. Straps 34, 36 may be designed to be adjustable but not releasable (e.g. by being designed like the commonly-used straps 21, 23 of brassieres 1, with the amount of folding of the straps 21, 23 being increased or decreased to adjust the length of the straps 21, 23). On the other hand, adjustable straps 34, 36 may be designed to be releasable. In a preferred embodiment, the split-strap undergarment 2 may be designed to be adjustable as well. In split-strap undergarments 2 that are adjustable, several means for fastening 34E, 34F and 36E, 36F are positioned at different positions on the first and second straps 34, 36, respectively. Thus, in order to adjust the length of the first and second straps 34, 36, the person solely has to use a means for fastening 34E, 34F and 36E, 36F at a different position. (Please refer to FIG. 4(*a*) and 4(*b*).) Similarly, the undergarments 2 that are used with brassieres 1 designed to be worn with halters have securing means 35 that provide an adjustable strap 38.

Figures 6A, 6B:
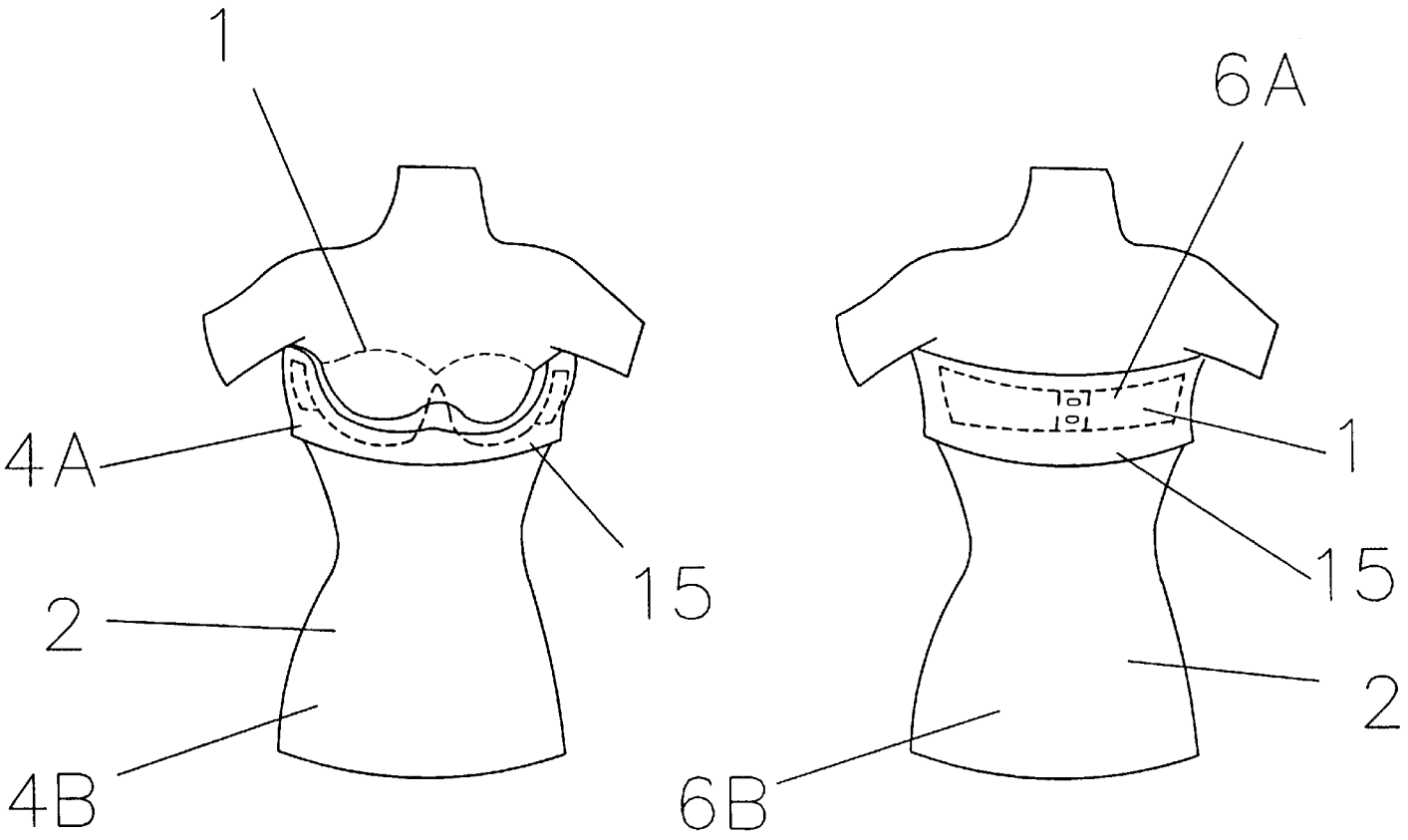
FIG. 6(*a*) is a front view of a strapless undergarment when worn by a user to underline a strapless brassiere, with the strapless brassiere shown by broken lines.

In FIGS. 6(a) and 6(b), a strapless undergarment 2 is shown that is designed to be used with a strapless brassiere 1. The strapless undergarment 2 is preferably made of a tubular fabric material having a circumference ranging from about 10 inches to about 60 inches. The back side 6 of the strapless undergarment 2 includes an upper section 6A and a lower section 6B. The front side 4 of the strapless undergarment 2 includes a lower section 4B, but the front side 4 may or may not include an upper section 4A. The lower section 4B of the front side 4 of the strapless undergarment 2 and the lower section 6B of the back side 6 of the strapless undergarment 2 preferably have a basically co-linear, generally straight, top edge. Similarly, if the front side 4 of the strapless undergarment 2 has an upper section 4A, the upper section 4A of the front side 4 and the upper section 6A of the back side 6 of the strapless undergarment 2 preferably have a basically co-linear, generally straight, top edge. After the strapless undergarment 2 and the strapless brassiere 1 are worn, the upper section 6A of the back side 6 of the strapless undergarment 2, that extends above the strapless brassiere 1, is turned over and covers a part of the strapless brassiere 1 that rests on the lower section 6B of the back side 6 of the strapless undergarment 2. Simultaneously, the upper section 4A of the front side 4 of the strapless undergarment 2 is turned over and covers a part of the strapless brassiere 1 that rests on the lower section 4B of the front side 4 of the strapless undergarment 2. When the strapless undergarment 2 is worn with a brassiere 1, the upper end 15 of the strapless undergarment 2 is generally positioned between about 2 inches and about 10 inches below the back arm's eye line. If desired, the upper section 6A of the back side 6 may be cut to reduce visibility when worn with a low-backed dress. Preferably, the strapless undergarment 2 has a length ranging from about 2 inches to about 71 inches on the front side 4.

If a greater stability of and minimal movements of the brassiere 1 are desired, securing means 35 may be used to hold the brassiere 1 in position on the undergarment 2 with or without attaching the brassiere 1 to the undergarment 2. Several arrangements of the securing means 35 may be used to strongly hold the straps 21, 23 (or strap 25) of the brassiere 1 in place on the undergarment 2 (referring to FIGS. 4(*c*) and 4(*d*)). Some versions of securing means 35 may be used to attached the straps 21, 23 (or strap 25) of the brassiere 1 to the straps 34, 36 (or strap 38) of the undergarment 2. Some versions of securing means 35 may be attached only to the straps 34, 36 (or strap 38) of the undergarment 2, but serve to hold the straps 21, 23 (or strap 25) of the brassiere 1 in position. It is also possible that securing means 35 may be attached only to the straps 21, 23 (or strap 25) of the brassiere 1, but serve to hold the straps 34, 36 (or strap 38) of the undergarment 2 in position. Although snaps, buttons or the like could be used as the securing means 35, hook and loop material are preferred. In a preferred embodiment, the securing means 35 that are attached to the straps 34, 36 (or to strap 38) of the undergarment 2, sandwich the straps 21, 23 (or strap 25) of the brassiere 1 (referring to FIGS. 4(*c*) and 4(*d*)). The hook and loop material are positioned along opposite edges of the first and second strap 34, 36 (or strap 38). After the first and second strap 21, 23 (or strap 25) of the brassiere 1 are each positioned on the first and second strap 34, 36 (or strap 38), respectively, of the undergarment 2, the hook and loop material are attached to sandwich the first and second strap 21, 23 (or strap 25) of the brassiere 1.

Figure 7A:
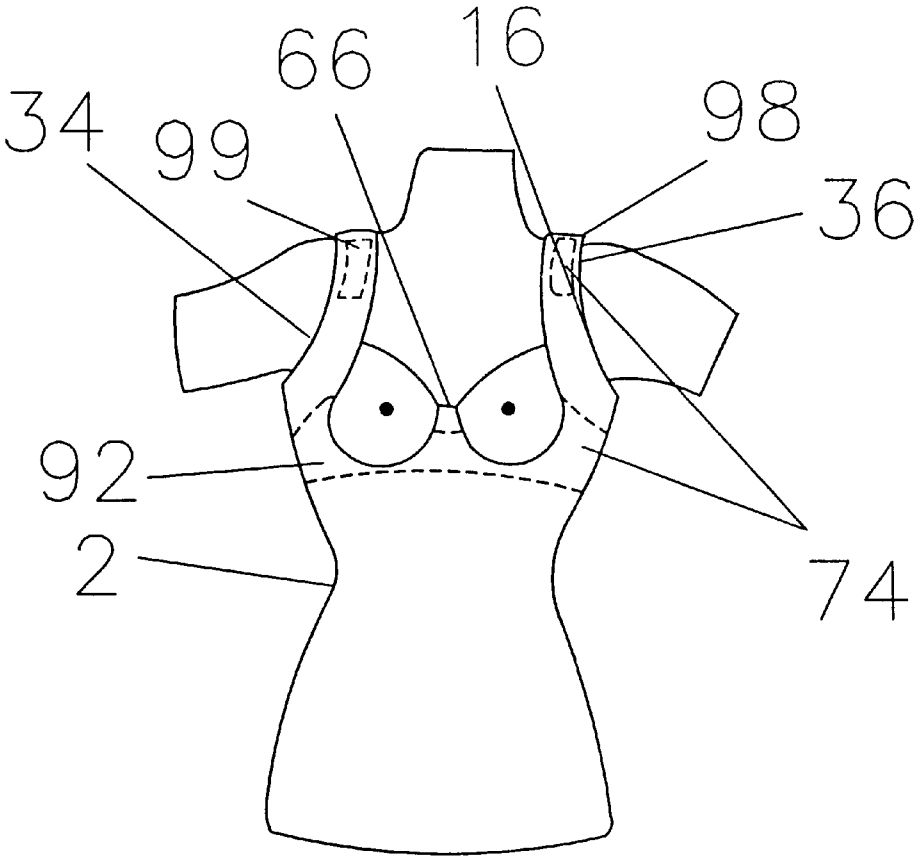
FIG. 7(*a*) is a front view of a cushioned undergarment, when worn by a user, with cushionings adjacent to the shoulder area and under the breasts shown by broken lines.
Figure 7B:
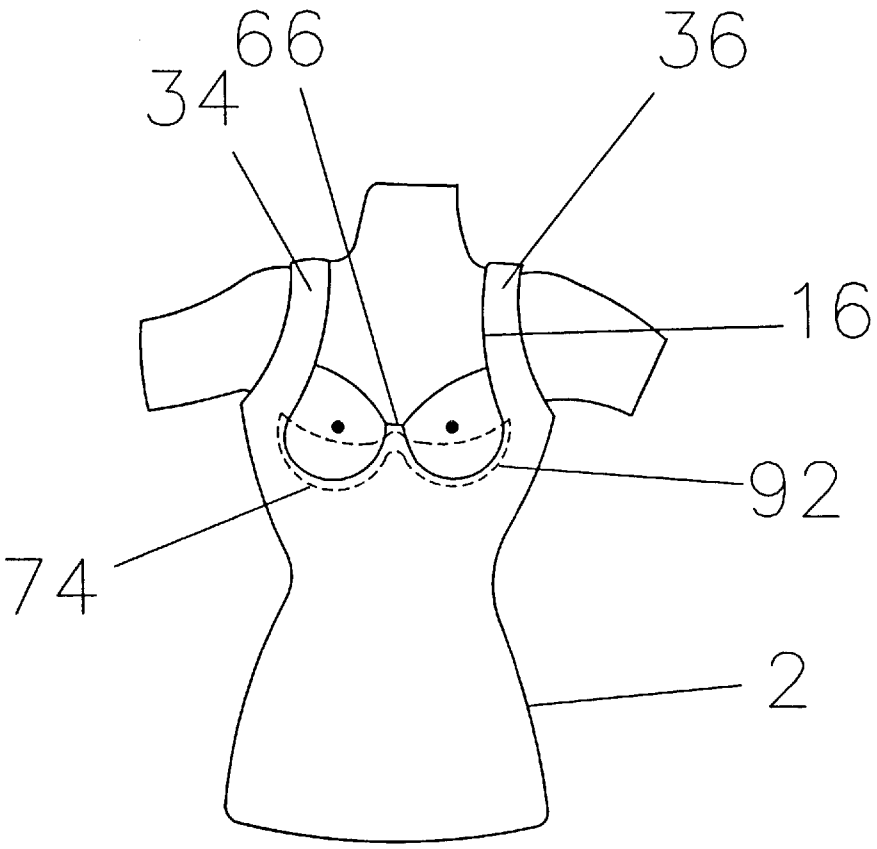

To provide more comfort, cushioning means 74 may be used in various parts of the undergarment 2 (please refer to FIGS. 7(*a*) and 7(*b*)). (Please note that cushioning means 74 may be used at any section of the undergarment 2. The following embodiments are chosen to more clearly demonstrate the application of cushioning means 74 and are not intended to, in any way, limit the use of cushioning means 74 in other parts of the undergarment 2. The application of the cushioning means 74 in different parts of the undergarment 2 are very similar with and correspond to the following examples.) Cushioning means 74 may be attached to the undergarment 2 or may be formed by adjusting parts of the undergarment 2 to provide layers. In the shoulder area, the cushioned undergarment 2 may be provided preferably by a number of pads 98 (e.g. built-in shoulder pads 99) or by a plurality of folds 91' (not shown) to minimize painful shoulder stresses resulting from pressure exerted by straps 21, 23 of the brassiere 1 and particularly encountered by women with relatively heavy breasts. The cushioning means 74 used to minimize any shoulder pain caused by straps 21, 23 of the brassiere 1 may be positioned in an area that is midway along the length of the first and second strap 34, 36. The cushioning means 74 may consists of a number of pads 98 positioned on or under the first and second strap 34, 36 of the fastenable undergarment 2. In one embodiment, pockets 76 (not shown) mounted to the first and second strap 34, 36 of the undergarment 2 are used to contain the number of pads 98. In another embodiment, the number of pads 98 are positioned in (e.g. by being sewn into) the first and second strap 34, 36 of the fastenable undergarment 2. Preferably, built-in shoulder pads 99 are between approximately 3 inches and 12 inches long and provide cushioning across the majority of the shoulder area. When a plurality of folds 91' are used, the multiple layers that are formed provide cushioning. The cushioning effect of the plurality of folds 91' is further enhanced by a fastening of a number of pads 98 in the folds 91'. To provide cushioning across the majority of the shoulder area, the cushioning means 74 may be between about 1 inch and about 21 inches long. To minimize the pain caused by the strap 25 of a brassiere 1 designed to be used with halters, cushioning means 74 may be used at the base of the neck.

Below the neck hole seam 11, a cushioning fold 92 may be used to provide a cushioning effect under the brassiere 1 (please refer to FIG. 7(*a*)). The cushioning fold 92 may extend horizontally across the front side 4 of the undergarment 2 and may have a seamed base. The lowermost portion of the cushioning fold 92 passes to a point up to about 16 inches below the front arm's eye line. The cushioning fold 92 generally silhouettes a lower front edge 52 of the brassiere 1 and is positioned below the breasts of the person at an area below the lower front edge 52 of the brassiere 1 and is positioned below the breasts of the person at an area below the lower front edge 52 of the brassiere 1. Preferably, the cushioning fold 92 extends outwardly along the front side 4 of the undergarment 2 so that the cushioning fold 92 lies on top of the undergarment 2. One of the problems encountered by women is that edges of the brassiere 1, particularly the lower front edges 52 of an under-wired brassiere 1, can cut into a woman's torso. The cushioning fold 92 is placed under and cushions the lower front edge 52 of the brassiere 1, minimizing irritations due to rubbing and pinching by the brassiere 2. The cushioning effect can be further enhanced by positioning a number of pads 98 in the cushioning fold 92. The pads 98 also increase the absorbency of the cushioning fold 92. The cushioning fold 92 may be shaped to serve as cups of the brassiere 1 (referring to FIG. 7(*b*)). Upon being positioned under the breasts of the user and extending upwards from under the breasts, the cup-shaped cushioning fold 92 supports, to a certain extend, the breasts. The cup-shaped cushioning fold 92 may be mostly used by ladies who want the support of a brassiere 1, but not desire to wear a brassiere 1.

Figure 8B:
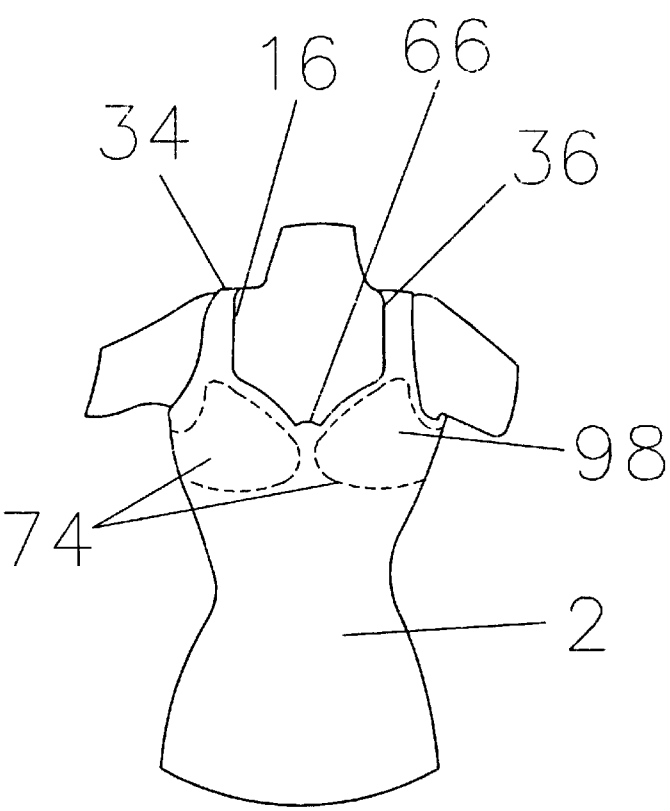
FIG. 8(*a*) is a front view of an undergarment for use by women with only one breast, with the undergarment being worn by a user and with any existing cushioning being shown by broken lines.
Figure 8A:
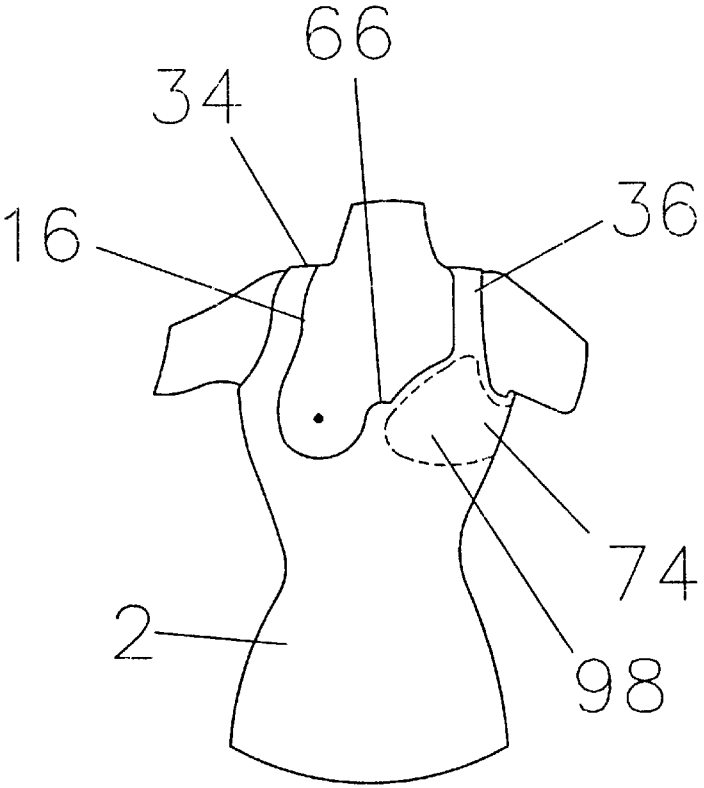

In addition, cushioning means 74 may be used to line an area where a breast is missing. (Please refer to FIGS. 8(*a*) and 8(*b*).) Cushioning means 74, such as a number of pads 98, may be attached to the undergarment 2 at a position where the cup of the brassiere 1 would be positioned. However, undergarments 2 that are designed for women who are missing only one breast may not be provided with cushioning means 74 at the position of the existing breast. Although different versions of the undergarment 2 are designed for women with missing breasts, the front neck hole seam 16 of the various versions of the undergarment 2 all include the "W" shape and the raised middle section 66.

The undergarment 2 is sized to snugly fit the user, with seams being used when desired. Generally, the undergarment 2 has a circumference ranging from about 10 inches to about 60 inches, depending on the stretchability of the tubular fabric material and the size of the user. The undergarment 2 may have a length varying over a wide range and, thus, can be used with clothes of various corresponding lengths. The undergarment 2 may have a length ranging from about 10 inches to about 80 inches as measured from the top of the first and second strap 34, 36 to the bottom seam 20 at the lower opening 10. It is preferred that the front side 4 be about 1 inch to about 6 inches longer than the back side 6 in all of the versions. Longer undergarments 2 permit the user to tuck the bottom seam 20 of the lower opening 10 into her pants or panties. In longer undergarments 2, one or more cuts towards the lower opening 10 could be used in order to provide comfort for users with larger waists and hips, extra space for movement of the legs and additional ventilation for the user. In a preferred embodiment, the cuts are in longitudinal alignment with the first and second armhole 12, 14 and are about 1 inch to about 40 inches long.

The neck hole 9 and the first and second armhole 12, 14 of the undergarment 2 are also made of various sizes and shapes of different applications. For a wider first and second strap 34, 36, a wider neck hole 9 is used to decrease the visibility of the undergarment 2. The first and second armhole 12, 14 of the undergarment 2 used with bare midriff clothes are not as large as in other embodiments, generally extending to about 1 inch below the arm's eye line in order to control perspiration. To provide greater comfort and easier concealment of the undergarment 2, the first and second armhole seam 26, 32 can both be generally D-shaped, with a curved portion and a straight portion that is positioned at the lower end 24, 30 of the first and second armhole 12, 14, respectively.

Although the undergarment 2 can be formed from many types of materials, it is preferred that a tubular fabric material be used in order to avoid side seams and to reduce potential discomfort and visibility under clothes. A stretchable tubular fabric material that tends to stay in position is desired. In providing a good fit, the material should be stretchable circumferentially more than it stretches longitudinally. A 100% cotton fabric having a stretchability in the range of from about 10% to about 30% along the warp and in the range of from about 10% to about 200% along the weft is expected to provide desirable results. A lightweight cotton underwear material should be highly suitable and can be doubled in thickness for increased comfort. Although any desired coloration can be used, the colors are selected in order to allow concealment of the undergarment 2 under clothes. The above components and related features apply to other versions of the undergarment listed below and will not be repeated for each version.

Figure 3B:
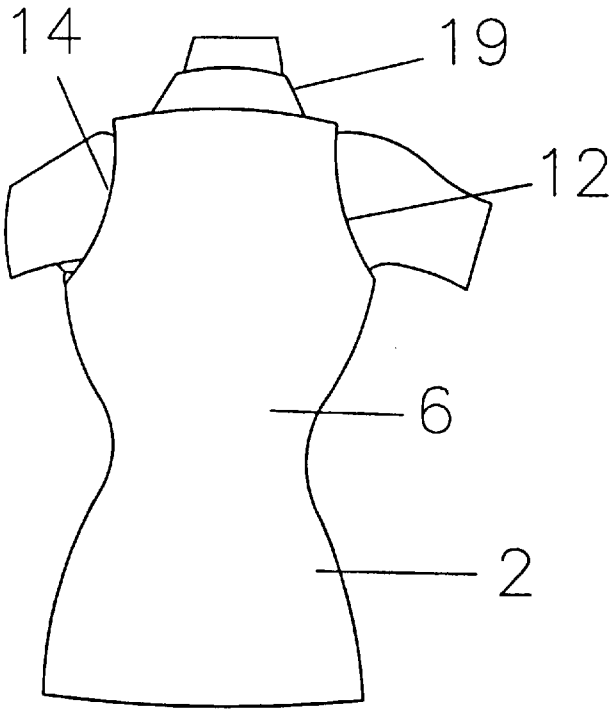
FIG. 3(*a*) is a front view of a collared undergarment, when worn by a user.
Figure 3A:
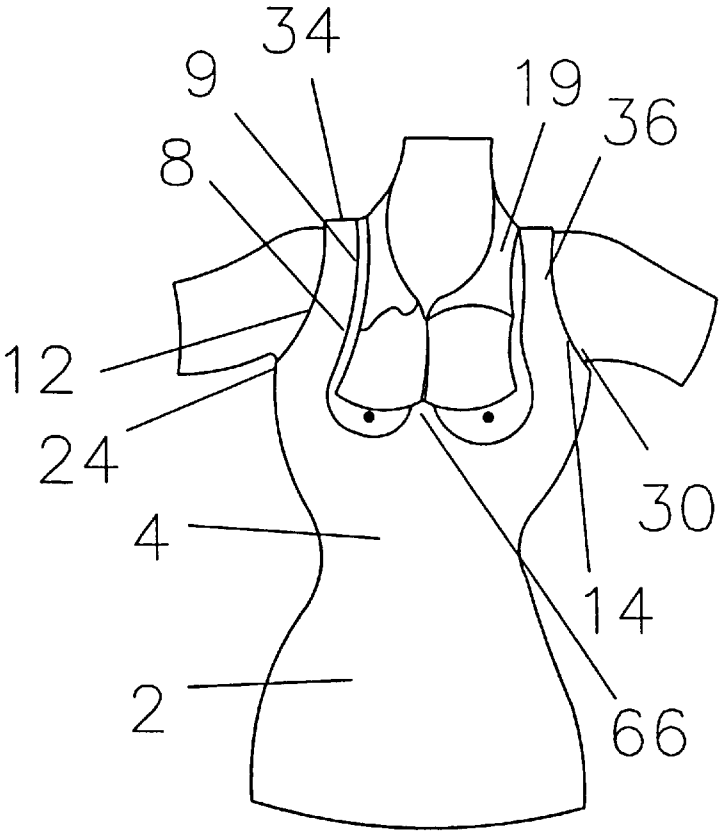
Figure 4B:
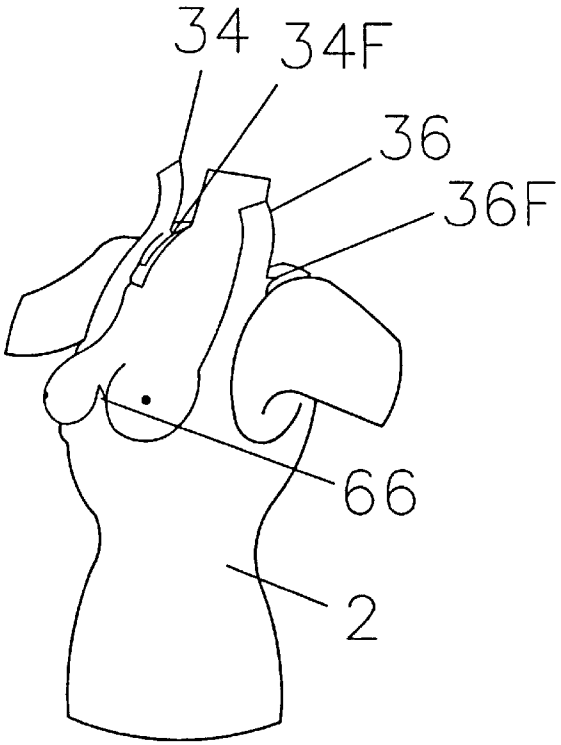
FIG. 4(*a*) is an angular side view of a split-strap undergarment that is not being worn by a user.
Figure 4A:
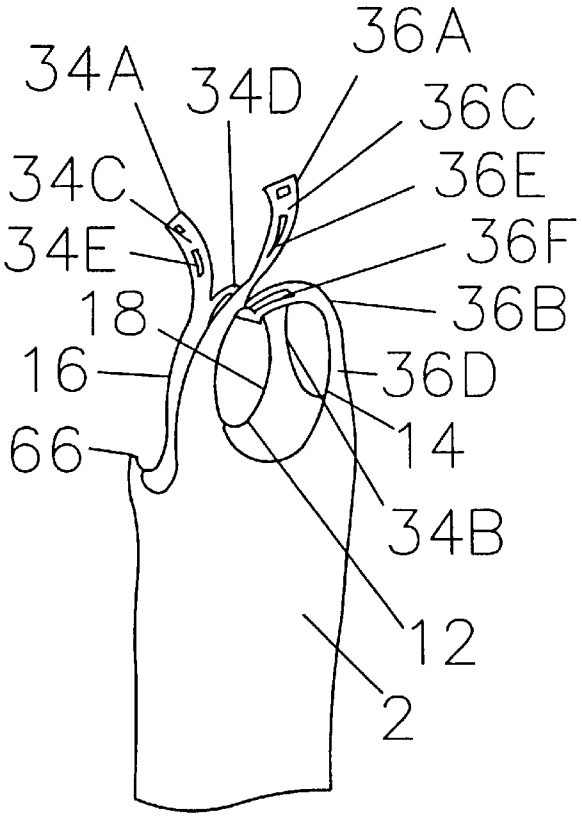
Figure 4D:
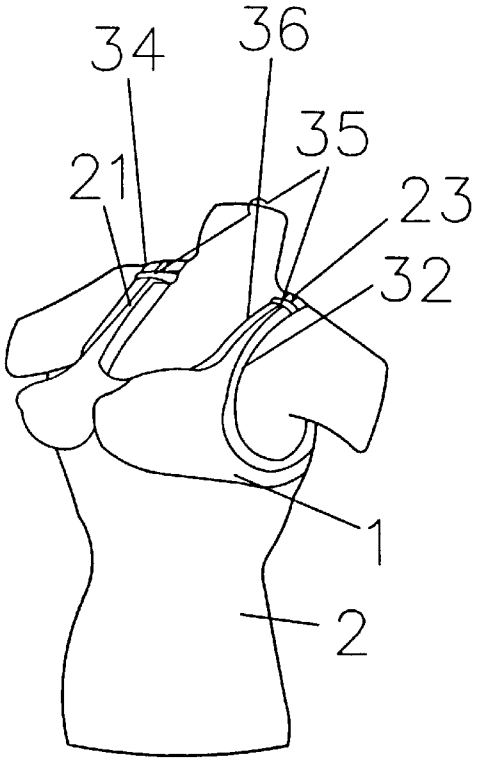
Figure 4C:
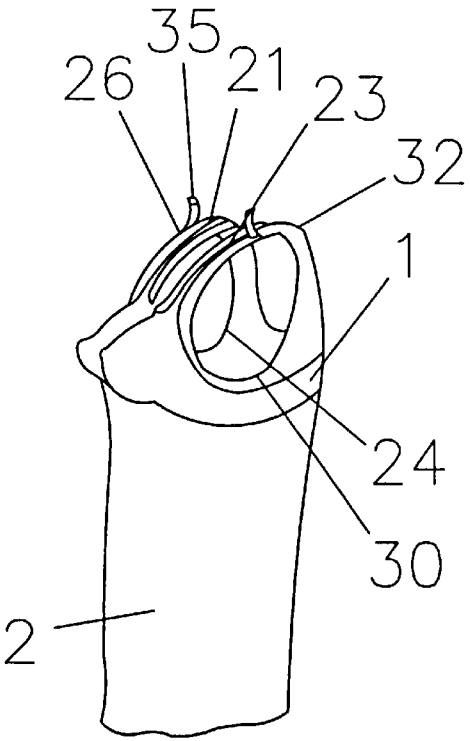
Figure 4F:
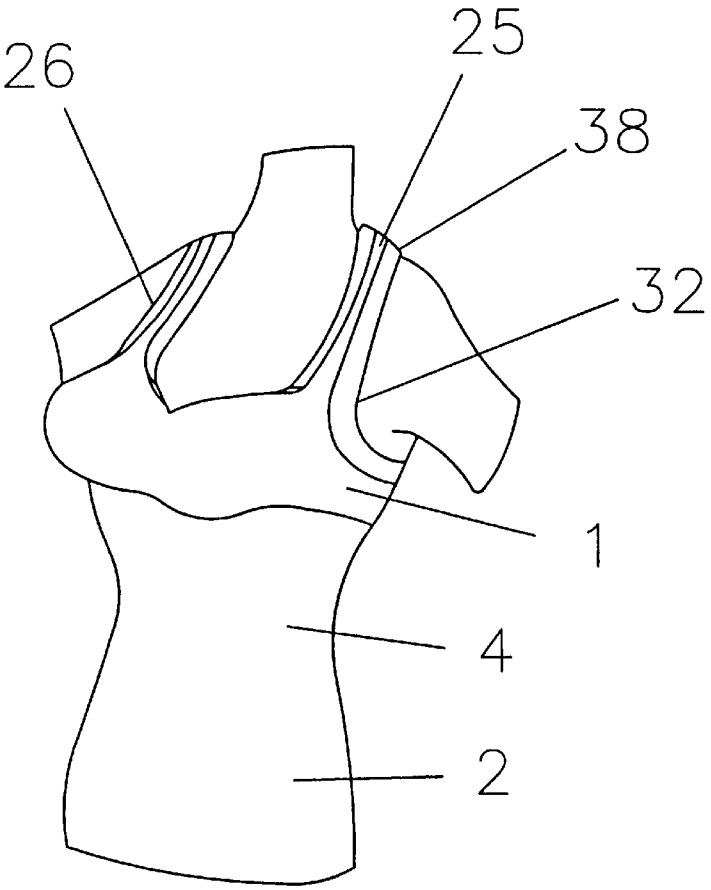
Figure 4E:
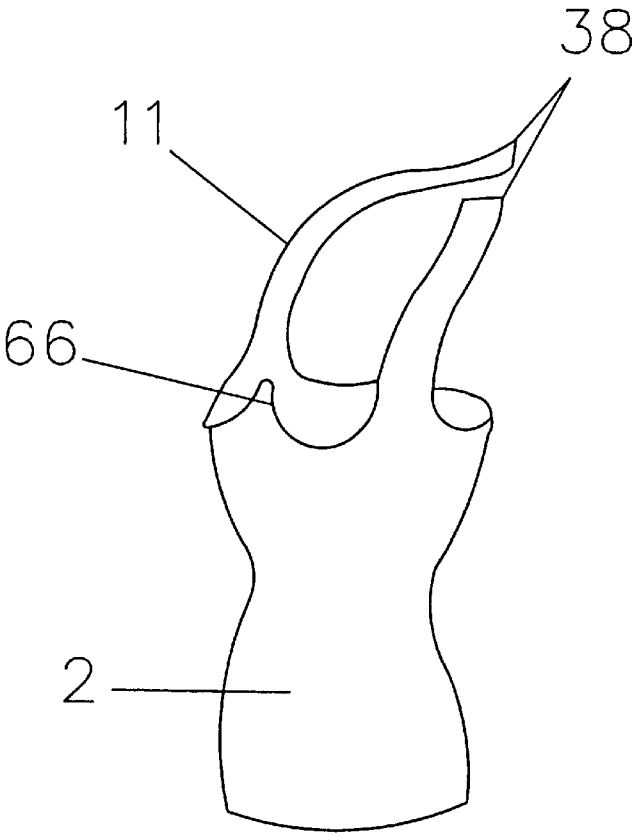
Figure 4G:
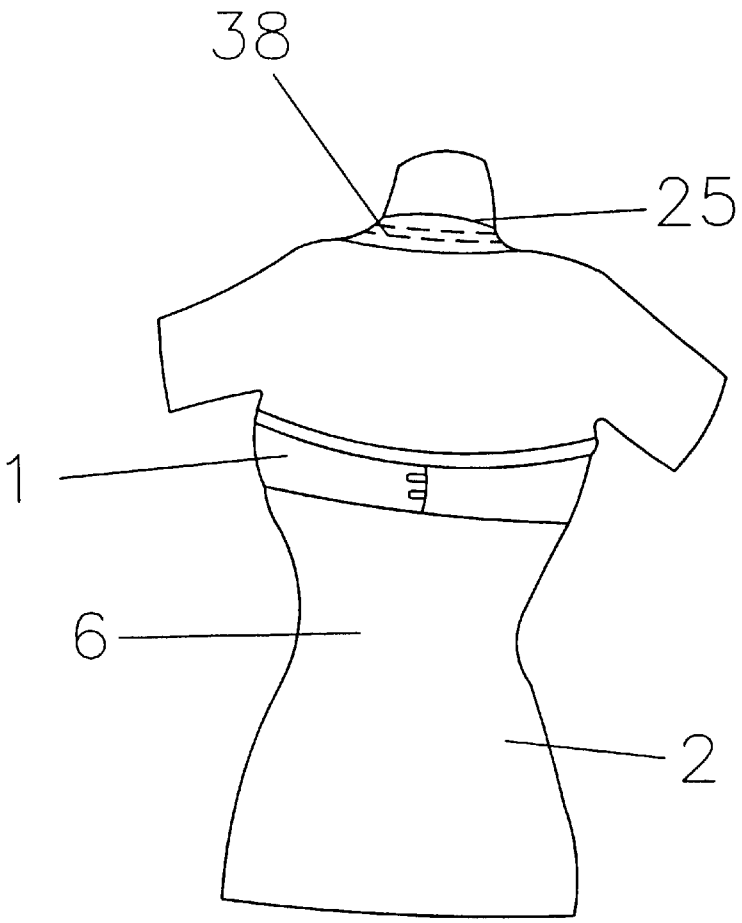

A collared undergarment 2, shown in FIGS. 3(*a*) and 3(*b*), includes a collar 19 that may be attached to the undergarment 2 at the vicinity of the upper opening 8 of the undergarment 2. Adjacent to the upper opening 8 of the collared undergarment 2, a part of the collar 19 may be attached to the back side 6 of the collared undergarment 2 and another part of the collar 19 may be attached to the straps 34, 36 of the collared undergarment 2. The back side 6 of the collared undergarment 2 may reach as far up as the neck of the user, such that the collar 19 may be attached to the back side 6 of the collared undergarment 2 to form a continuous back side 6 that has no openings. The lower end 24 of the first armhole 12 and the lower end 30 of the second armhole 14 each have a low cut and reach at least 2 inches below the arm's eye line. The low cut of the first armhole 12 and of the second armhole 14 reduce the possibility of the collared undergarment 2 being visible through armholes of outerwear positioned thereover. The collar 19 is open and preferably V-shaped and is either a continuation of the back side 6 or terminates at a position above the back neck hole seam 18.

Figure 2B:
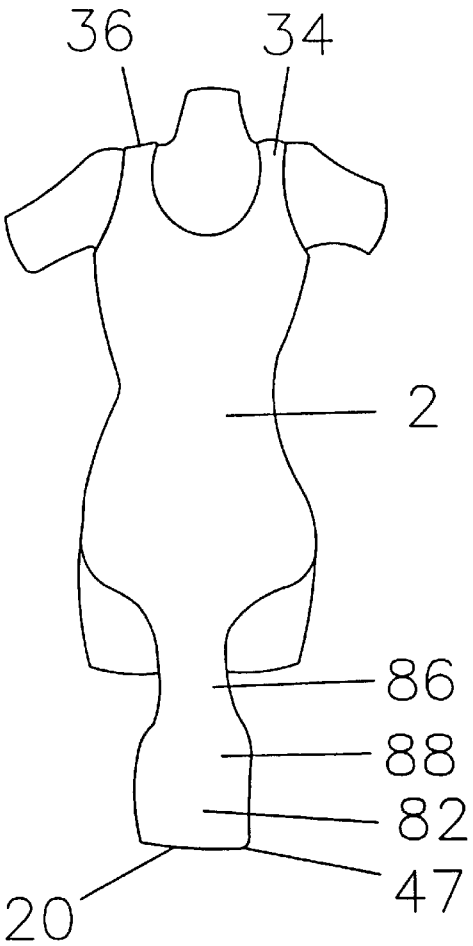
FIG. 2(*a*) is a front view of a body-suit undergarment when worn by a user.
Figure 2A:
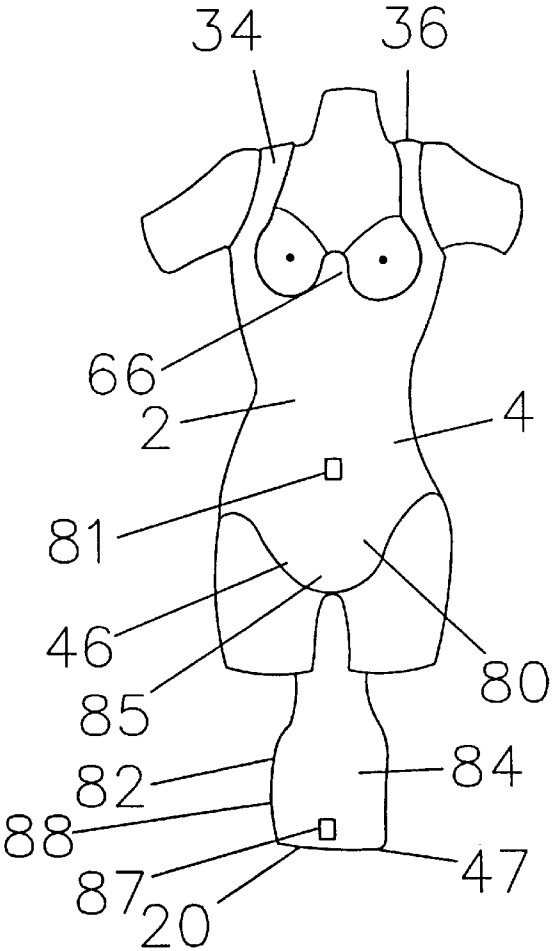

A body-suit undergarment 2, shown in FIGS. 2(*a*) and 2(*b*), includes a lower end 88. The back hem 47 of the lower opening 10 of the body-suit undergarment 2 may be lower than the front hem 46 of the lower opening 10. The bottom seam 20 defines the lower opening 10, a front tongue 80 and a back tongue 82. The front tongue 80 extends from the front side 4 and the back tongue 82 extends from the back side 6 of the body-suit undergarment 2. The body-suit undergarment 2 is particularly designed such that the back tongue 82 would be sufficiently low and would have a shape to cover the buttocks of the user. The front and the back tongue 80, 82 each taper toward the lower end 88 of the body-suit undergarment 2 and have an inner surface 83, 84 and an outer surface 85, 86, respectively (with the inner surface 83 of the front tongue 80 not shown). The back tongue 82 would be passed between the legs of the user, turned upwards and extended upwards to be attached to the front side 4 of the undergarment 2. The body-suit undergarment 2 further comprises a first fastener half 87 on the inner surface 84 of the back tongue 82 and a mating second fastener half 81 on the outer surface 85 of the front tongue 80. The first fastener half 87 and the second fastener half 81 are both positioned near the lower end 88 of the body-suit undergarment 2. The back tongue 82 is in the range of about 10 inches to about 30 inches longer than the front tongue 80 and preferably has a minimum width of about 1 inch, such that the front tongue 80 can be fastened to the back tongue 82 on the front side of the user's body. The first fastener half 87 of the back tongue 82 is attached to the second fastener half 81 of the front tongue 80 at a position in the range of not more than about 8 inches beneath the navel. A number of hook and loop fasteners can serve as the first and the second fastener half 87, 81. The application of four hook and loop fasteners has provided desirable results.

Figure 9B:
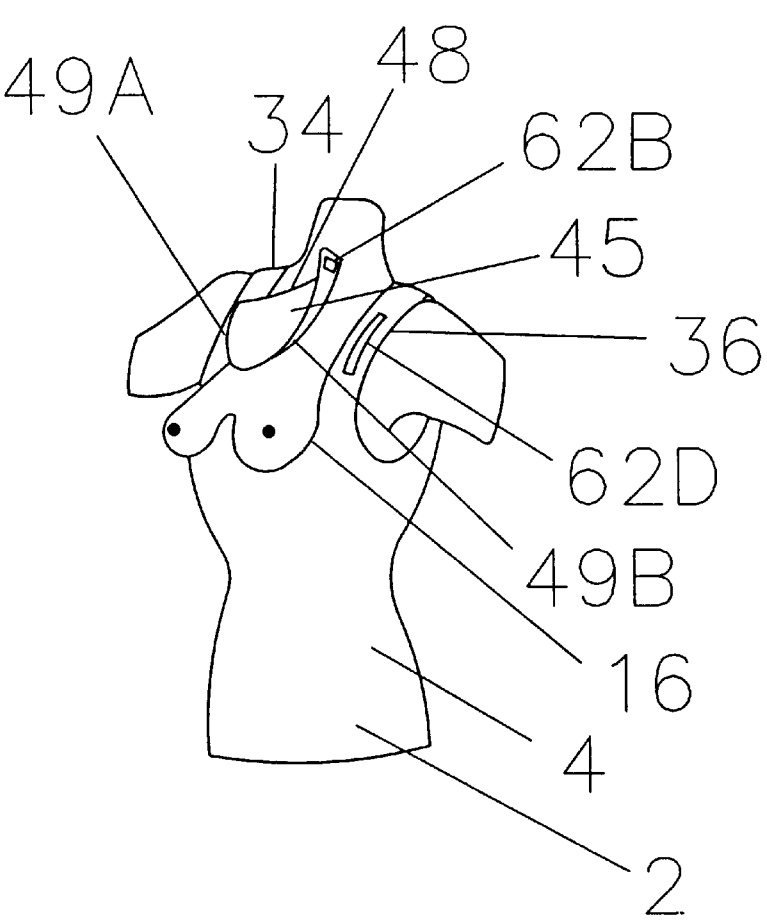
FIG. 9(*a*) is a front view of an undergarment to which is a patch attached when worn by a user.
Figure 9A:
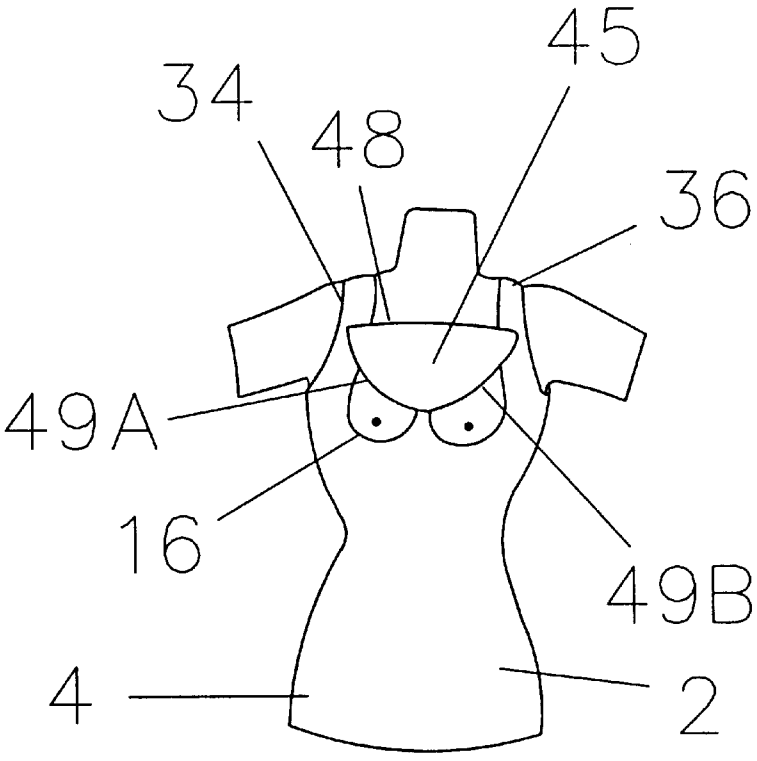

In one embodiment of the undergarment 2, a patch 45 is either removably or irremovably attached to the front neck hole seam 16 (please refer to FIGS. 9(*a*) and 9(*b*)). The patch 45 may be used to line braces or other devices that are being worn and that may protrude from the proximity of the breasts. The patch 45 has a top edge 48 and a first and second side edge 49A, 49B. Preferably, the patch 45 is shaped like a shield, with the top edge 48 being between about 4 inches and about 20 inches long and the first and second side edge 49A, 49B being between about 4 inches and about 16 inches long. The top edge 48 of the patch 45 may be attached to the front neck hole seam 16 by tacking sections at the ends of the top edge 48 of the patch 45 with the front neck hole seam 16. The attachment encompasses a relatively small portion of the entire length of the top edge 48 of the patch 45. Desirably, upon aligning the longitudinal centerline of the patch 45 with the longitudinal centerline of the front side 4 of the undergarment 2, the patch 45 may be tacked to the front neck hole seam 16 along the aligned longitudinal centerlines. Some portions adjacent to the first and second side edge 49A, 49B of the patch 45 may not fall above and cannot be tacked to the front neck hole seam 16. The patch 45 may be attached more strongly to the front neck hole seam 16 if the patch 45 has a shape and dimensions that maximize intersection of the patch 45 with the front neck hole seam 16 when the patch 45 is being used. The attachment may continue from the intersections of the top edge 48 of the patch 45 with the front neck hole seam 16 down towards the center of the front neck hole seam 16. Therefore, the patch 45 is designed to have side edges 49A, 49B that follow the front neck hole seam 16 of the undergarment 2 as closely as possible.

In a preferred embodiment, the patch 45 may be removably attached to the front neck hole seam 16 of the undergarment 2 by using hook and loop material. A pair of first fastener halves 62A, 62B of the patch 45 are removably attached to a pair of mating second fastener halves 62C, 62D positioned on the undergarment 2 adjacent to the front neck hole seam 16 (with 62A and 62C not shown). The first fastener halves 62A, 62B of the patch 45 are positioned adjacent to the intersection of the top edge 48 with the first and second side edge 49A, 49B of the patch 45. When the first fastener halves 62A, 62B of the patch 45 are attached to the second fastener halves 62C, 62D of the undergarment 2, the patch 45 may hang freely above the undergarment 2 or may be lifted and tucked into the breast folds. If desired, an additional fastener half 62E (not shown) may be attached to the patch 45 adjacent to the intersection of the first and second side edge 49A, 49B. The additional fastener half 62E may be attached to a mating fastener half 62F (not shown) that is positioned on the undergarment 2. Naturally, an increased number of fastener halves strengthens the connection between the patch 45 and the undergarment 2.

Figure 5B:
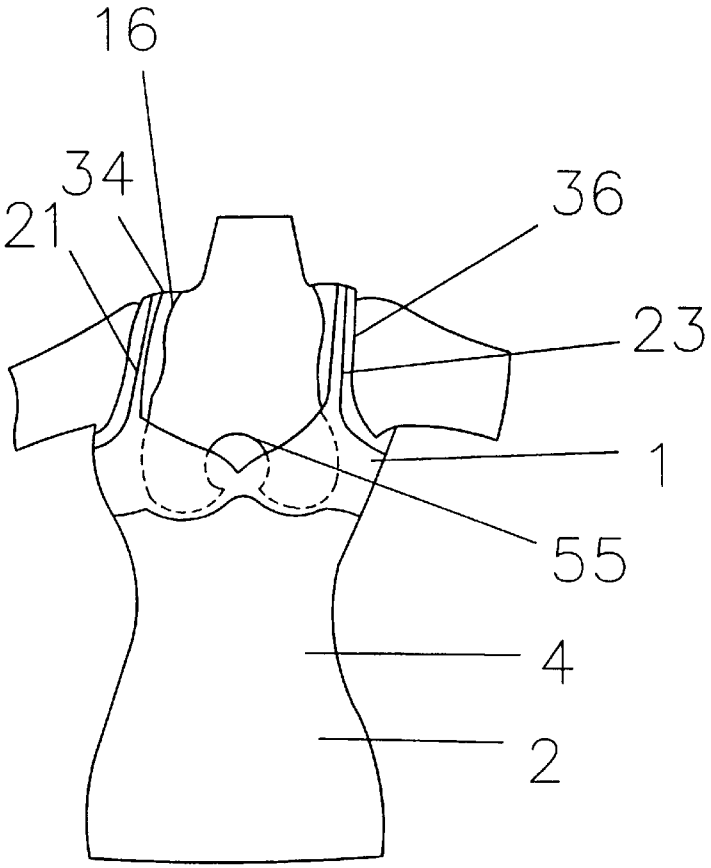
FIG. 5(*a*) is a front view of an undergarment with a self-attached flap when not worn by a user.
Figure 5A:
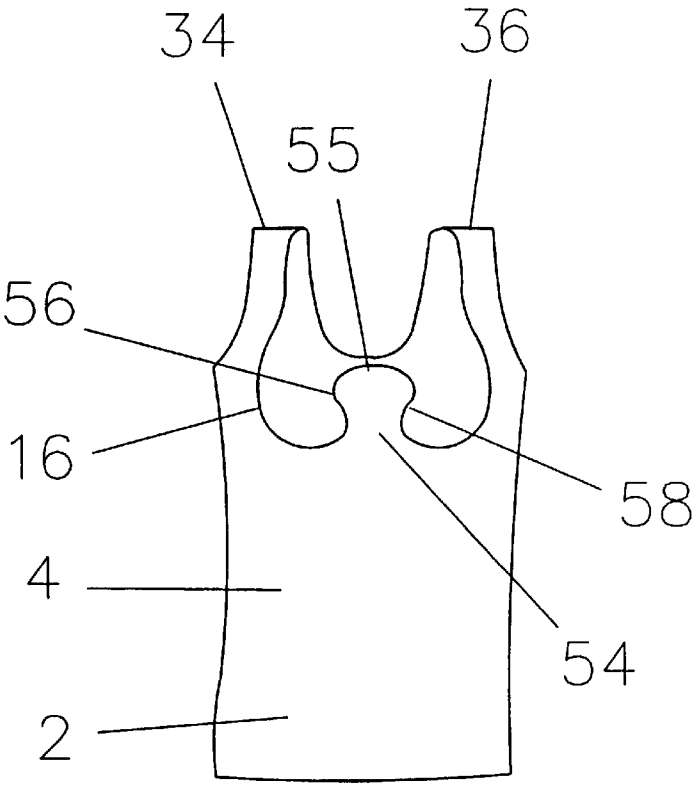

To absorb moisture from the skin and to minimize irritation, the undergarment 2 includes a flap 55 that is attached to the front neck hole seam 16. The flap 55 is positioned between the folds of the breasts (please refer to FIGS. 5(*a*) and 5(*b*)). The flap 55 may be either removably or irremovably attached to an area adjacent to the central portion of the front neck hole seam 16. The flap 55 may be an extension of the front side 4 of the undergarment 2 (as shown in FIG. 5(*a*)). The flap 55 may be folded and lifted into the breast folds. The flap 55 may be formed into a pocket by fastening a first side edge 56 of the flap 55 to a second side edge 58 of the flap 55 along a longitudinal seam and by fastening a bottom edge 54 of the flap 55 upon itself. The pocket could be used to hold baby powder, for example, to further enhance the function of the flap 55. A number of pads 98 (not shown) may be fastened into the pocket to increase the absorbency of the flap 55 and to provide or increase the space between the breasts.

Figure 10B:
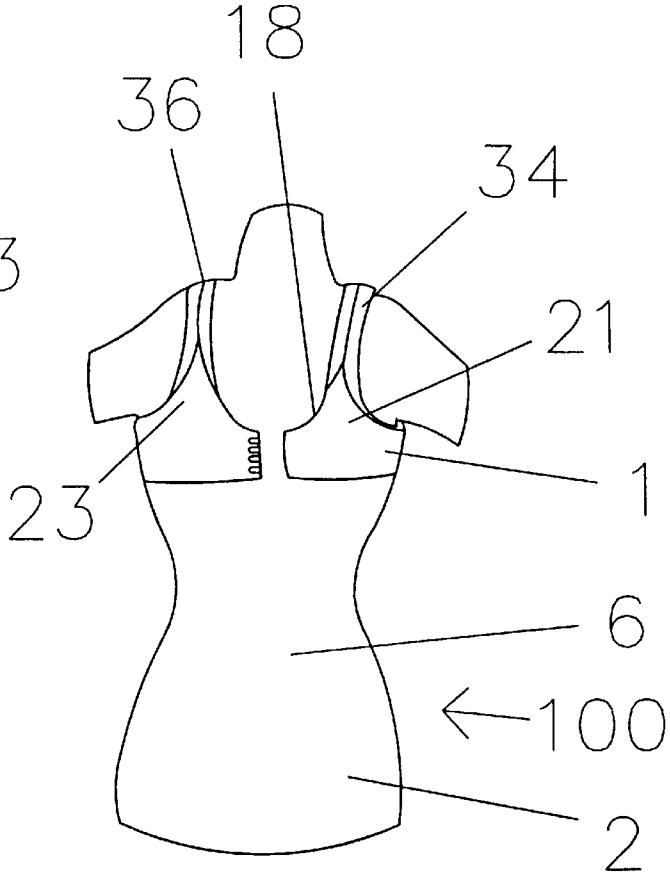
FIG. 10(*a*) is a front view of a brassiere-undergarment when worn by a user.
Figure 10A:
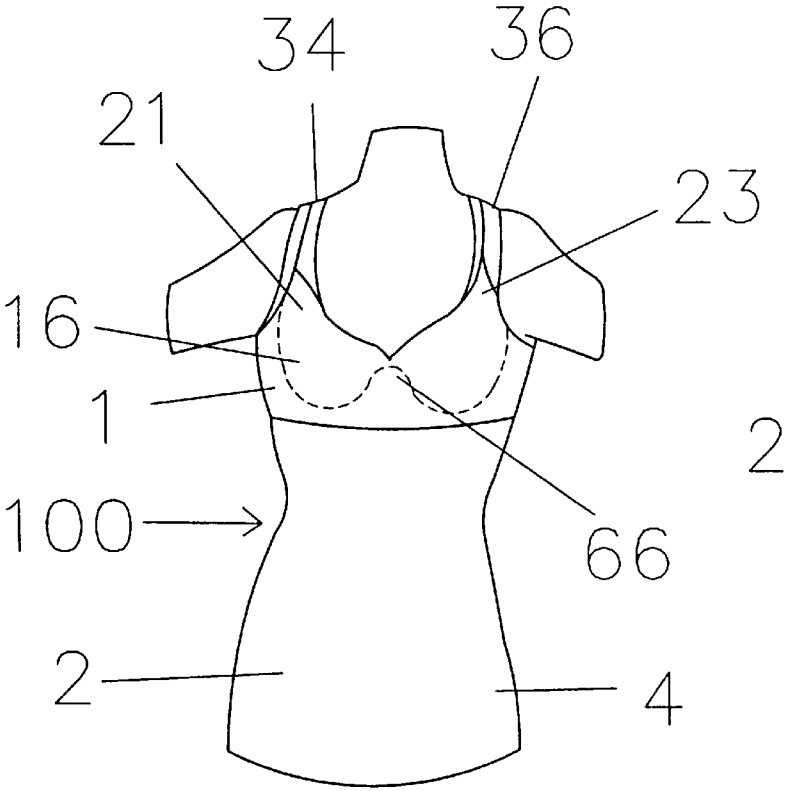

In one embodiment, referred to as a brassiere-undergarment 100, a brassiere 1 is integral with an undergarment 2 (please refer to FIGS. 10(*a*) and 10(*b*)). For maximum comfort, it is desirable to minimize the movements of the brassiere 1 with respect to and over the undergarment 2 and to control the positioning of the brassiere 1. In the brassiere-undergarment 100, the undergarment 2 is irremovably attached to the brassiere 1 and, thus, any movement of the brassiere 1 over the undergarment 2 is avoided. In a preferred embodiment, a middle portion of the straps 21, 23 of the brassiere 1 may be irremovably attached to (for example by being irremovably sandwiched by or sewn to) a corresponding portion of the straps 34, 36 of the undergarment 2. A front portion of the straps 21, 23 of the brassiere 1 and a back portion of the straps 21, 23 of the brassiere 1 may rest, preferably without having any attachments, over a corresponding portion of the straps 34, 36 of the undergarment 2. Other sections of the brassiere 1 that generally rest over the undergarment 2 when the brassiere 1 is worn over the undergarment 2 (i.e. when a separable brassiere 1 is worn over a separable undergarment 2), may be irremovably attached to the sections of the undergarment 2 that rest under the brassiere 1 in the brassiere-undergarment 100. Different versions of brassiere-undergarments 100 may be designed. For example, the brassiere-undergarment 100 may be designed for use under halters, for use as a body-suit, with a flap, with cushioning, with a collar, with straps that may be split, or several combinations thereof. Although many other designs of the brassiere-undergarment 100 may be practical, all such designs include a brassiere 1 that is irremovably attached to an undergarment 2.

Figure 11B:
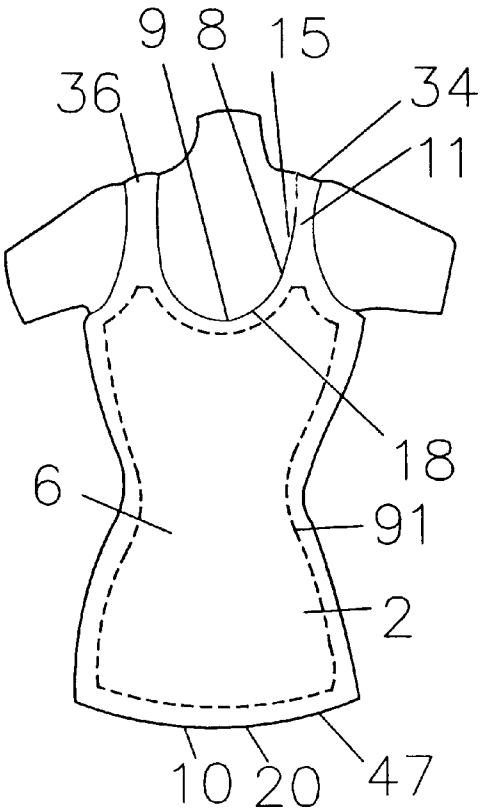
FIG. 11(*a*) is a front view of a girdle-undergarment when worn by a user.
Figure 11A:
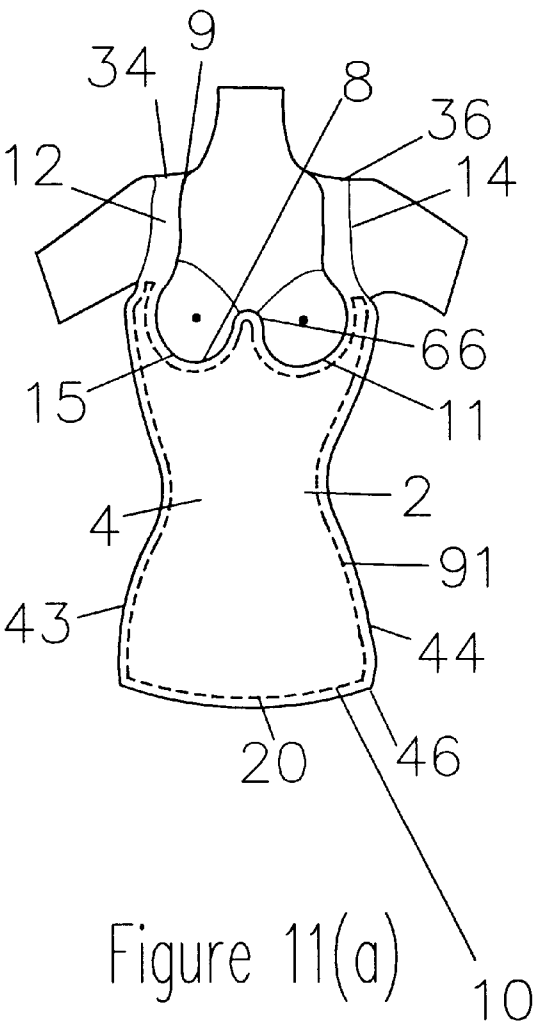
Figure 12B:
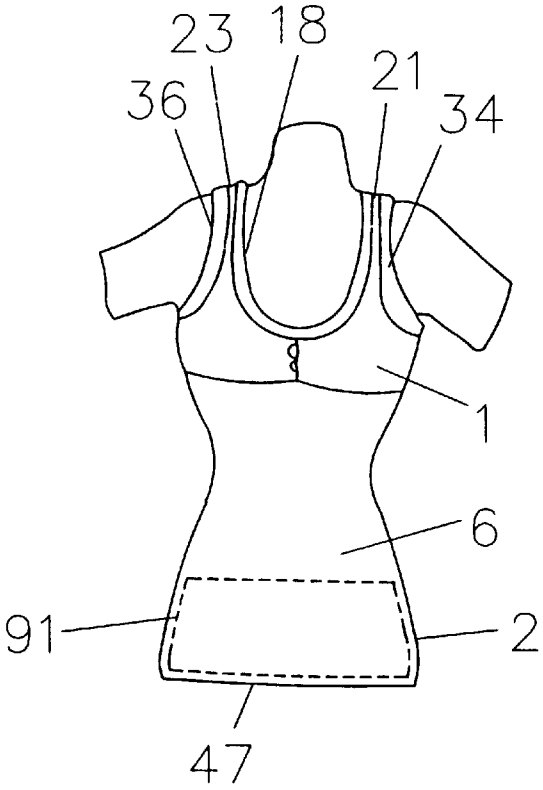
FIG. 12(*a*) is a front view of a girdle-undergarment, when worn by a user to underline a brassiere.
Figure 12A:
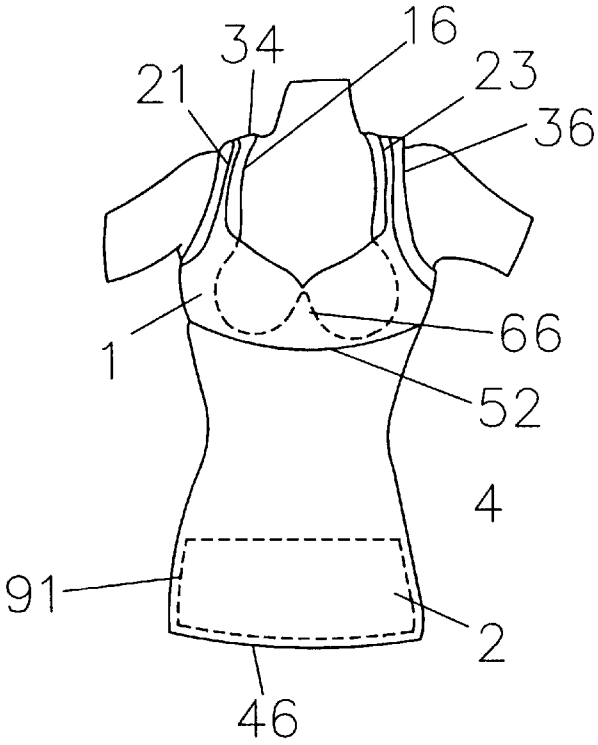

In another embodiment, referred to as a girdle-undergarment 2, the undergarment 2 is combined with and attached to a girdle 91 (shown by dotted lines in FIGS. 11(*a*), 11(*b*), 12(*a*), 12(*b*), 13(*a*), 13(*b*), 14(*a*), 14(*b*), 15(*a*), 15(*b*), 16(*a*), 16(*b*), 17(*a*), 17(*b*), 18(*a*) and 18(*b*)) to be worn by the user as one unit. Basically all features that apply to other versions of the undergarment 2 apply to the girdle-undergarment 2 as well and will not be repeated separately. The girdle-undergarment 2 firmly controls, trims, shapes and supports parts of the body including the waist, stomach, hips, torso, derriere, shoulders, sides, back and legs. The girdle-undergarment 2 offers firm, elasticized control without using heavy panels. Being a flexible, elasticized, soft panel, the girdle-undergarment 2 provides light, smooth and comfortable figure control. The thickness, flexibility, number of layers and elasticity of the panel are optional. At a minimum, the girdle-undergarment 2 consists of a reinforced triple layer panel. In a preferred embodiment, the girdle-undergarment 2 is sufficiently reinforced by a panel to be capable of performing its function (e.g. helping to straighten a user's shoulder, to support a user's back, to control a user's hips, to control a user's stomach, to improve a user's posture etc.). In a preferred embodiment, a triple layer panel is used to reduce bulges of parts of body (e.g. waist, torso, stomach, hips, legs and derriere).

Figure 17B:
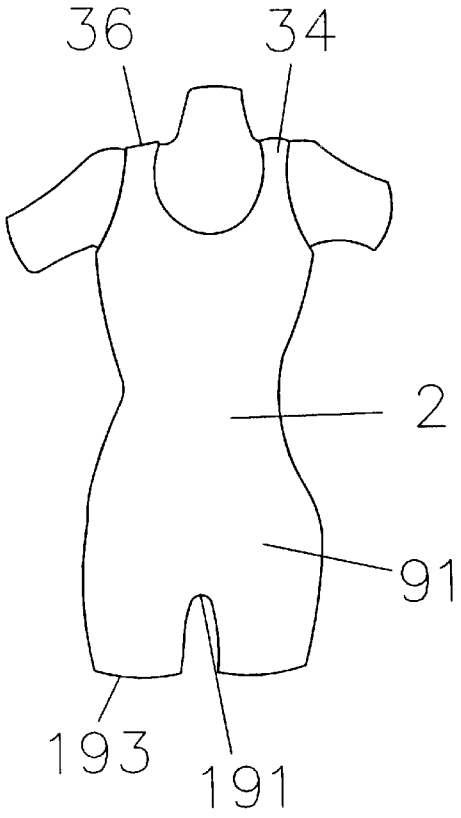
FIG. 17(*a*) is a front view of a girdle-undergarment, with a girdle attached as an extension, when worn by a user.
Figure 17A:
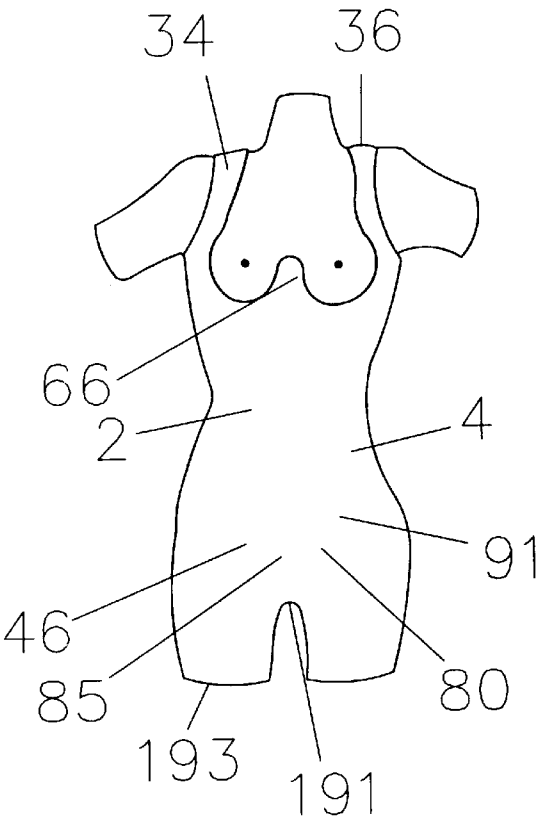
Figure 18B:
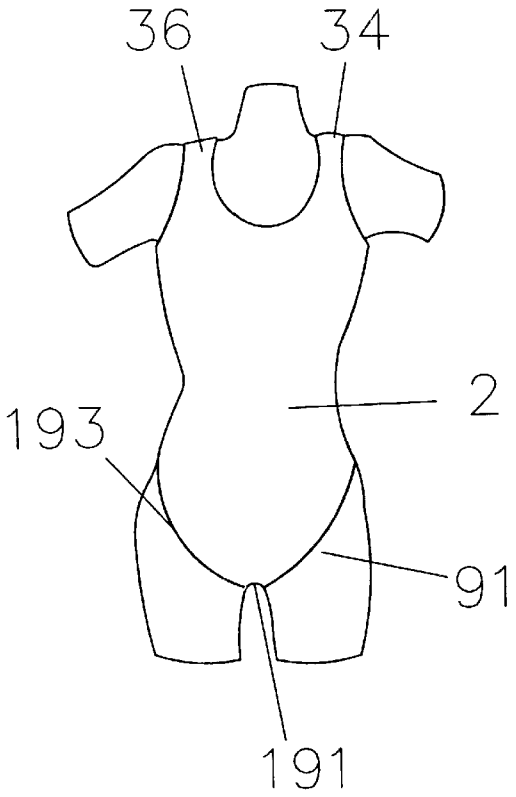
FIG. 18(*a*) is a front view of a girdle-undergarment, with a girdle attached as an extension, when worn by a user.
Figure 18A:
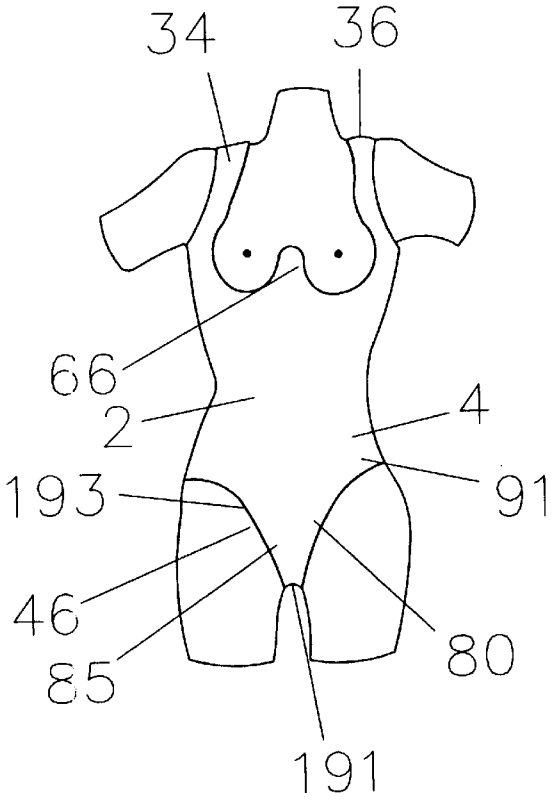

The undergarment 2 is combined with and attached to the girdle 91 and is worn by the user as one unit. The girdle 91 may be combined with the undergarment 2 in two general embodiments: the girdle 91 may be attached to the undergarment 2 as a padding (as shown in FIGS. 11(*a*), 11(*b*), 12(*a*), 12(*b*), 13(*a*), 13(*b*), 14(*a*), 14(*b*), 15(*a*), 15(*b*), 16(*a*) and 16(*b*)) or the girdle 91 may be an extension of the undergarment 2 (as shown in FIGS. 17(*a*), 17(*b*), 18(*a*) and 18(*b*)). If attached to the undergarment 2 as an extension, the girdle 91 may form legs for the undergarment 2 or the girdle 91 may form openings for passage of legs of user into and out of the undergarment 2.

Although the undergarment 2 can be formed from many types of materials, it is preferred that the girdle 91 of the undergarment 2 is cotton-lined, but the girdle 91 itself is of elastic material. In girdle-undergarments 2 which have girdles 91 attached as a padding, reinforced triple layer panels are preferred. It is preferred that an elastic fabric material that tends to be comfortable and return back to original position after stretching be used.

Figure 13B:
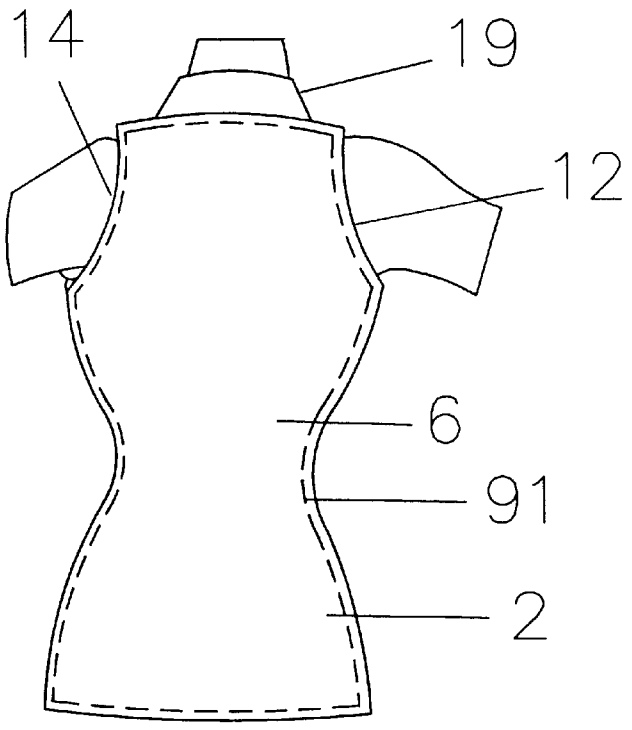
FIG. 13(*a*) is a front view of a collared girdle-undergarment, when worn by a user.
Figure 13A:
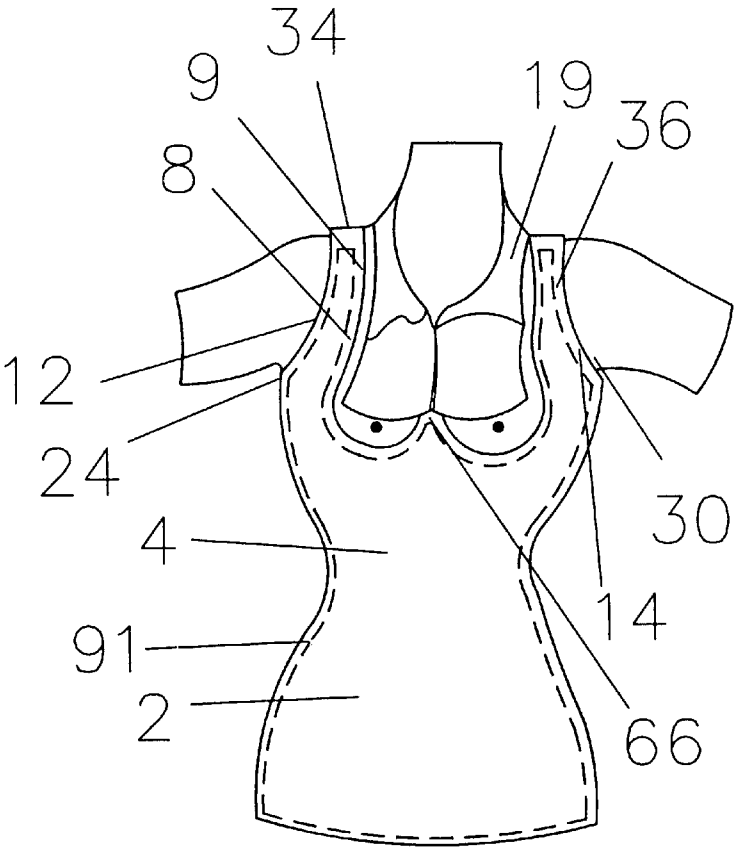
Figure 14B:
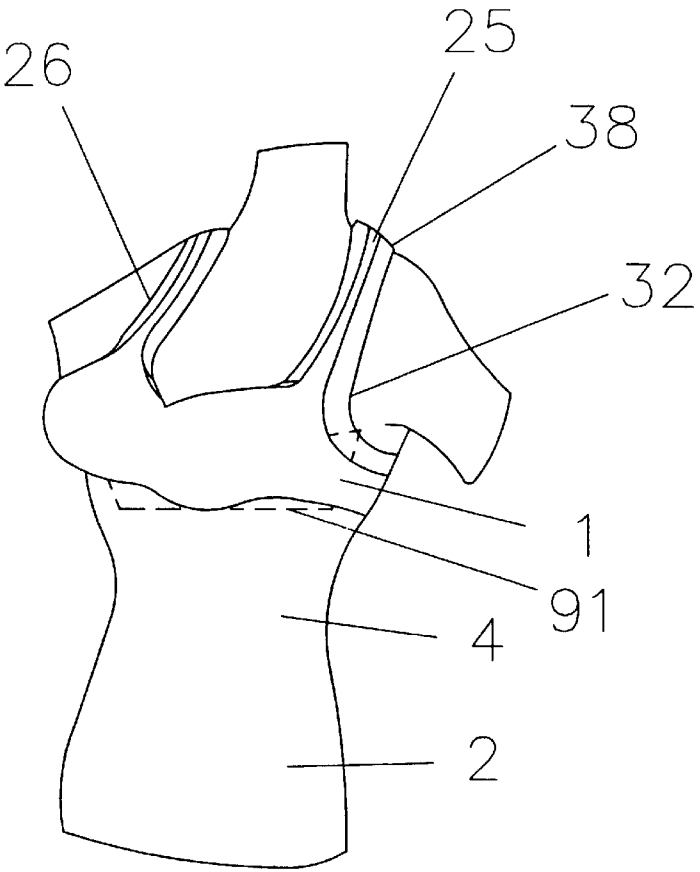
FIG. 14(*a*) is an elevated angular view of a version of a split-strap girdle-undergarment that is to be used with a brassiere designed for halters, when the split-strap undergarment is not being worn by a user.
Figure 14A:
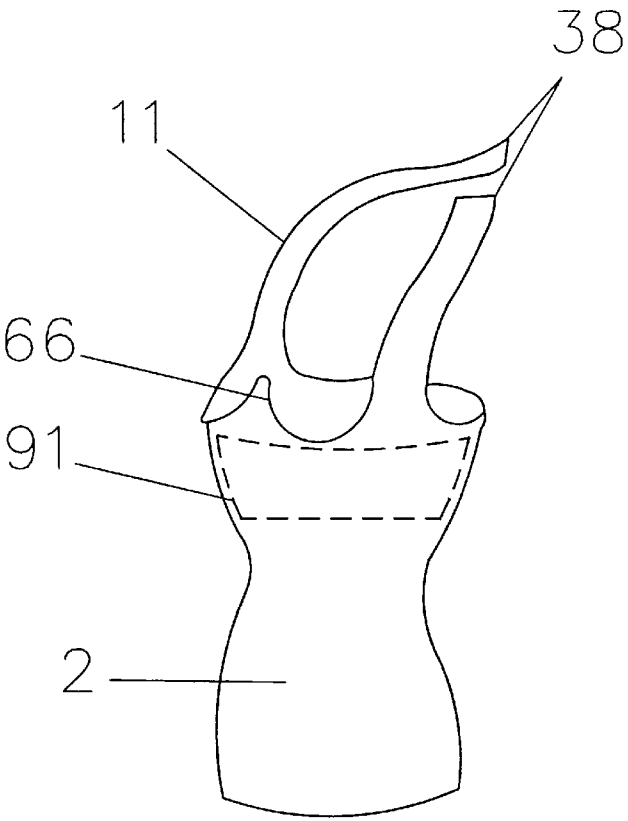
Figure 15B:
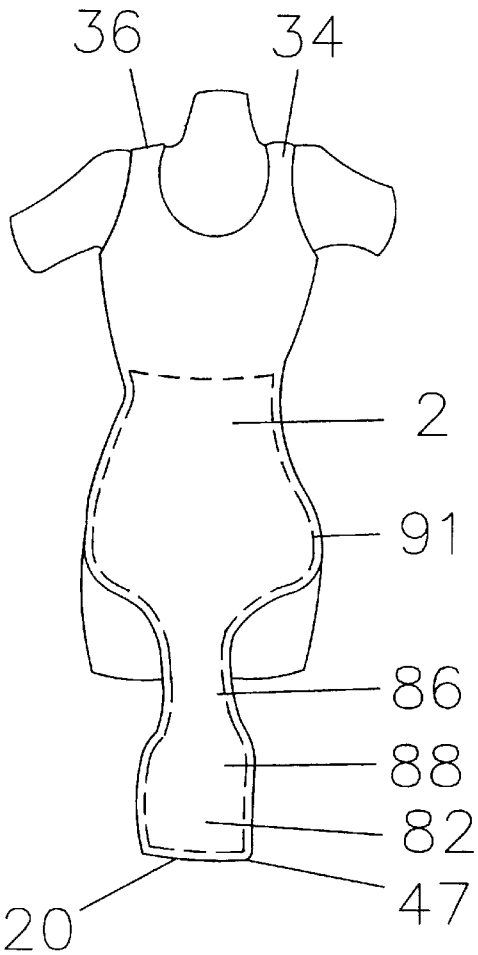
FIG. 15(*a*) is a front view of a body-suit undergarment, padded with a girdle, when worn by a user.
Figure 15A:
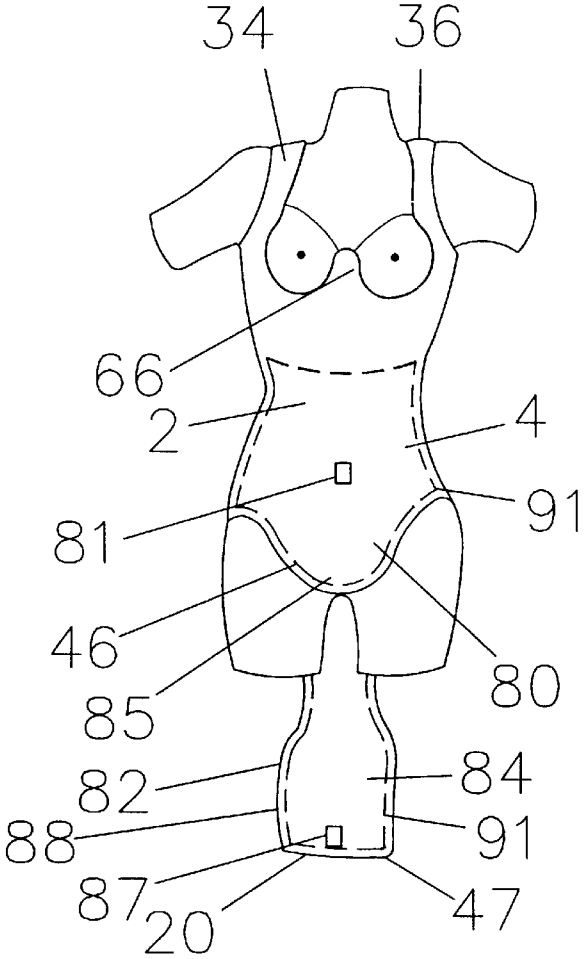
Figure 16B:
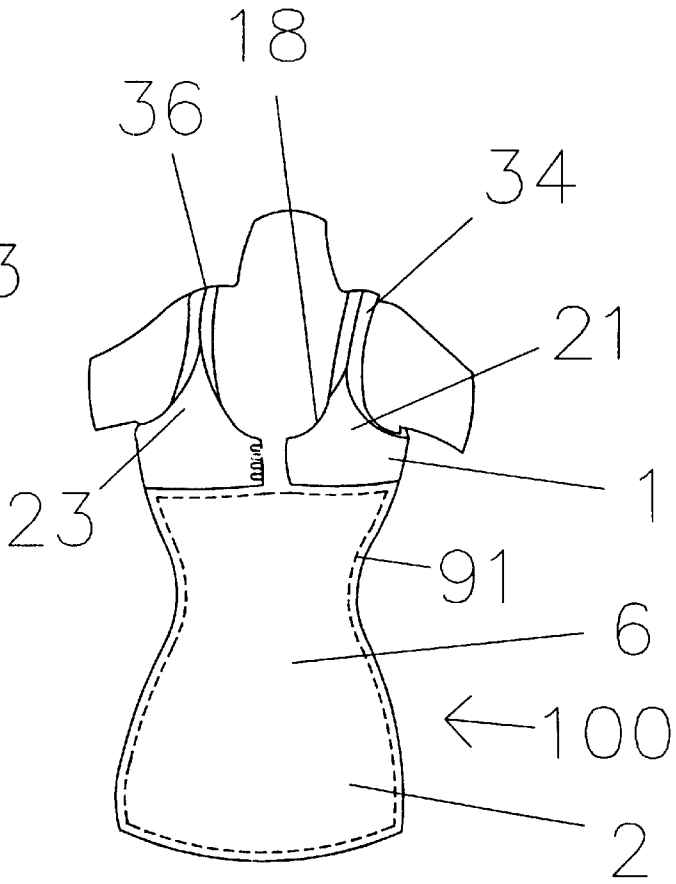
FIG. 16(*a*) is a front view of a brassiere-undergarment, padded with a girdle, when worn by a user.
Figure 16A:
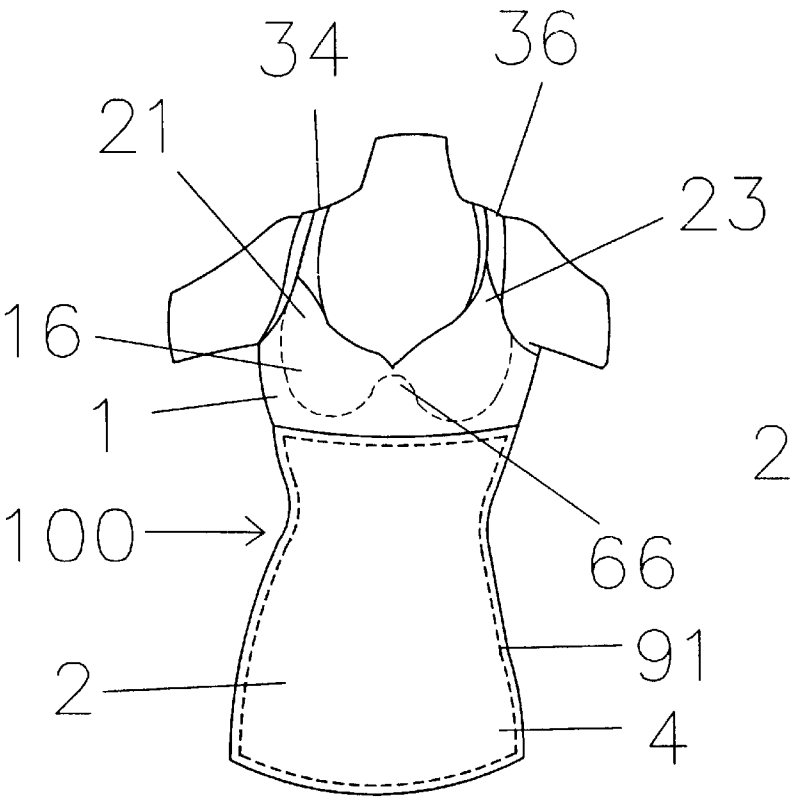

Whether used with a collared undergarment 2 (refer to FIGS. 13(*a*) and 13(*b*)), or a body-suit undergarment 2 (refer to FIGS. 15(*a*) and 15(*b*)) or with a brassiere-undergarment (refer to FIGS. 16(*a*) and 16(*b*)), when the girdle 91 is attached as a padding, the girdle 91 appears within a reinforced panel in the realm of the area of the undergarment 2. In the body-suit undergarment 2, the back hem 47 of the lower opening 10 of the undergarment 2 is lower than the front hem 46 of the lower opening 10, with the back hem 47 being shaped to cover buttocks of the person and to be passed between legs of the person turned upwards and extended upwards to be attached to the front side 4 of the undergarment 2 and with the back hem 47, the front hem 46 and the lower opening 10 of the undergarment 2 being all padded with a girdle 91.

However, when the girdle 91 is used as an extension of the undergarment 2, the undergarment 2 slips under the girdle 91 and the girdle 91 is not attached as a padding of the undergarment 2. Rather, the girdle 91 serves as an added extension to the undergarment 2, such that the girdle 91 serves as a slippage for the undergarment 2 and as a passage for legs of the user. The girdle 91 that is added as an extension to the undergarment 2 may have a closed bottom 191 with leg openings 193 that provide passage for the legs of the user. With a closed bottom 191 and leg openings 193, the girdle-undergarment 91 can be basically described as a bikini, boxer, brief, tap or a girdle 91 extending straight downwardly from the undergarment 2.

Certain objects are set forth above and made apparent from the foregoing description, drawings and examples. However, since certain changes may be made in the above description, drawings and examples without departing from the scope of the invention, it is intended that all matters contained in the foregoing description, drawings and examples shall be interpreted as illustrative only of the principles of the invention and not in a limiting sense. With respect to the above description and examples then, it is to be realized that any descriptions, drawings and examples deemed readily apparent and obvious to one skilled in the art and all equivalent relationships to those stated in the examples and described in the specification or illustrated in the drawings are intended to be encompassed by the present invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention. It is also to be understood that the following claims are intended to cover all of the generic and specific features of the invention herein described, and all statements of the scope of the invention which, as a matter of language, might be said to fall in between.

I claim:

1. A lady's undergarment to be worn on an upper portion of a person's body having an upper portion, a lower portion and a pair of arms, said body having a circumference as measured closely beneath the pair of arms referred to as an arm's eye line, said undergarment being formed from a tubular fabric material defining a front side, a back side, a left side, a right side, an upper opening and a lower opening, wherein the lower opening of said undergarment is in the form of a single opening for receipt of the lower portion of the body, said lower opening defined by a generally bevel front hem positioned on the front side of the undergarment, and a generally straight back hem positioned on the back side of the undergarment, said front hem extending from a lower edge of the right side to a lower edge of the left side and having a lowermost portion which passes to a point below the back hem, and wherein a neck hole forms the upper opening, said neck hole being defined by a neck hole seam having a front neck hole seam positioned on the front side of the undergarment, and a back neck hole seam positioned on the back side of the undergarment, wherein the back neck hole seam is generally U-shaped and a lowermost portion of the back neck hole seam passes to a point about even with the back arm's eye line, wherein the front neck hole seam is generally W-shaped in order to include a raised middle portion that divides the undergarment into two scoops and that falls in between breasts of the person to maximize lining effect of the undergarment by minimizing movements of the undergarment, and a lowermost portion of the front neck hole seam passes to a point below at least 2 inches below the front arm's eye line, and wherein a girdle is attached to the undergarment.

2. The undergarment of claim 1 wherein the girdle is enclosed within the undergarment as a padding.

3. The undergarment of claim 1 wherein the girdle is an extension of the undergarment.

4. The undergarment of claim 3 wherein the girdle forms legs for the undergarment.

5. The undergarment of claim 3 wherein the girdle forms openings for passage of legs of user into and out of the undergarment.

6. The undergarment of claim 1 wherein the back hem of the lower opening of the undergarment is lower than the front hem of the lower opening, with the back hem being shaped to cover buttocks of the person and to be passed between legs of the person turned upwards and extended upwards to be attached to the front side of the undergarment and with the back hem, the front hem and the lower opening of the undergarment being all padded with a girdle.

7. The undergarment of claim 1 further being inseparably attached to a brassiere.

8. The undergarment of claim 1 further including a strap connecting two portions of the front side of the undergarment to one another and adapted to pass around the person's neck.

9. The undergarment of claim 1 further including a pair of releasable straps connecting the front side of the undergarment to the back side of the undergarment and adapted to pass over the person's shoulder.

10. The undergarment of claim 1 further including securing means on the undergarment for holding a brassiere worn by the person in position on the undergarment and minimizing movements of the brassiere on the undergarment, with or without attaching the brassiere to the undergarment.

11. The undergarment of claim 1 further including a flap attached to the raised middle section of the front neck hole seam of the undergarment and adapted to lie at the folds of the person's breasts to absorb moisture.

12. The undergarment of claim 11 wherein the flap has a first side edge, a second side edge and a bottom edge, said first side edge fastened to said second side edge along a longitudinal seam and said bottom edge fastened upon itself, forming a pocket wherein a pad or powder is positioned to increase absorbency of the flap.

13. The undergarment of claim 1 further including cushioning means attached to the undergarment at any section of the undergarment where increased cushioning is needed for a part of the person's body which underlies the cushioned section of the undergarment.

14. The undergarment of claim 13 wherein the cushioning means comprises at least one cushioning fold extending across the front side of the undergarment and adapted to be positioned below the breasts of the person at an area below a lower front edge of a brassiere worn by the person.

15. The undergarment of claim 13 further including shoulder straps and wherein the cushioning means comprises at least one pad extending along an upper section of each shoulder strap of the undergarment and adapted to be positioned under each strap of a brassiere worn by the person, providing increased cushioning for the shoulders.

16. The undergarment of claim 13 further including a plurality of folds that extend along each strap for forming a multi-layer pad on each strap.

17. The undergarment of claim 13 wherein the cushioning means extends upwards from under a person's breasts to cover a portion of the breasts and is shaped to serve as cups for supporting breasts of the person when the person is not wearing a brassiere.

18. The undergarment of claim 1 further including an extension over a section of the person's body where at least one cup of a brassiere would be positioned when the brassiere is worn, with cushioning being provided for the extension to line an area where a breast is missing.

19. The undergarment of claim 1 further including a collar attached, at the vicinity of the upper opening of the undergarment, to the back side of and to each strap of the undergarment and adapted to serve as a collar for outer garments worn by the person.

20. The undergarment of claim 1 including a back side that extends as far up as the shoulders and further including a collar attached at the neck hole seam to the undergarment and adapted to serve as a collar for outer garments worn by the person.

21. The undergarment of claim 1 further including a pair of straps and a triangular patch attached at two corners to the straps of the undergarment and adapted to cover chest area of the person.

22. The undergarment of claim 1 further including an upper section and a lower section in the front side and in the back side and said undergarment being adapted to be worn with a strapless brassiere, with the back neck hole seam and the front neck hole seam being generally straight and the upper section of the front side and the upper section of the back side extending above the brassiere, such that when the strapless brassiere is worn by the person, the upper section of the back side of the undergarment that extends above the brassiere is turned over to cover a part of the brassiere that rests on the lower section of the back side of the undergarment and the upper section of the front side of the undergarment is turned over to cover a part of the brassiere that rests on the lower section of the front side of the undergarment.

* * * * *